US007284372B2

(12) United States Patent
Crow

(10) Patent No.: US 7,284,372 B2
(45) Date of Patent: Oct. 23, 2007

(54) METHOD AND APPARATUS FOR CONVERTING THERMAL ENERGY TO MECHANICAL ENERGY

(76) Inventor: Darby Crow, 1230 Mineral Flat Rd., Reno, NV (US) 89506

( * ) Notice: Subject to any disclaimer, the term of this patent is extended or adjusted under 35 U.S.C. 154(b) by 481 days.

(21) Appl. No.: 10/982,167

(22) Filed: Nov. 4, 2004

(65) Prior Publication Data

US 2006/0090467 A1 May 4, 2006

(51) Int. Cl.
*F01B 29/10* (2006.01)

(52) U.S. Cl. ..... 60/519; 60/520; 60/525

(58) Field of Classification Search ..... 60/517, 60/518, 519, 520, 521, 525
See application file for complete search history.

(56) References Cited

U.S. PATENT DOCUMENTS

| | | | | | |
|---|---|---|---|---|---|
| 9,909 | A | | 8/1853 | Willcox | |
| 23,876 | A | | 5/1859 | Wilcox | |
| 27,180 | A | | 2/1860 | Wilcox | |
| 542,846 | A | | 7/1895 | Diesel | |
| 673,462 | A | | 5/1901 | Thornton et al. | |
| 2,939,286 | A | * | 6/1960 | Pavlecka | 60/652 |
| 3,329,575 | A | * | 7/1967 | Burbach et al. | 376/317 |
| 3,772,883 | A | * | 11/1973 | Davoud et al. | 60/653 |
| 3,867,816 | A | | 2/1975 | Barrett | |
| 3,990,243 | A | | 11/1976 | Davoud | |
| 4,050,253 | A | | 9/1977 | Eskeli | |
| 4,120,161 | A | | 10/1978 | Gedeit | |
| 4,196,594 | A | | 4/1980 | Abom | |
| 4,270,351 | A | | 6/1981 | Kuhns | |
| 4,490,974 | A | | 1/1985 | Colgate | |
| 4,715,185 | A | * | 12/1987 | Salo | 60/677 |
| 5,016,441 | A | | 5/1991 | Pinto | |
| 5,209,065 | A | | 5/1993 | Sakata | |
| 5,809,784 | A | | 9/1998 | Kreuter | |
| 5,894,729 | A | | 4/1999 | Proeschel | |
| 6,109,035 | A | | 8/2000 | Guruprasad | |

* cited by examiner

*Primary Examiner*—Hoang Nguyen
(74) *Attorney, Agent, or Firm*—Rod D. Baker

(57) ABSTRACT

A method and apparatus for converting thermal energy to mechanical energy which can use a wide range of fuels and perform with a high efficiency. Operating on a little utilized thermodynamic cycle of isentropic compression, isothermal expansion, isentropic expansion and finally constant pressure cooling and contraction. The external heat engine utilizes a heat exchanger carrying heat from the external energy source to the working parts of the engine. Pistons and cylinders are activated by appropriate means to adiabatically compress the working fluid, for example ambient air, to transfer the entire mass of the air through the heat exchanger to accomplish isothermal expansion followed by adiabatic expansion and, finally, exhaust the air to ambient to allow for constant pressure cooling and contraction. Valve pistons in conjunction with the cylinders form valves that allow for the exchange of working fluid with ambient. Energy is added to the engine during isothermal expansion, whereby the energy of compression is added by a flywheel or other appropriate energy storage means, said flywheel stores energy recovered during adiabatic expansion. The thermodynamic cycle described and the engine embodiments disclosed, when run in reverse, perform as a heat pump or refrigeration device.

88 Claims, 18 Drawing Sheets

METHOD AND APPARATUS FOR CONVERTING THERMAL ENERGY TO MECHANICAL ENERGY

BACKGROUND OF THE INVENTION

1. Field of the Invention (Technical Field):

The present invention relates to engines, specifically to an engine utilizing an improved method for using external heat to heat a unit mass of working fluid and thereby convert the thermal energy to mechanical energy, where the unit mass is later expelled and a new unit mass of working fluid is introduced to repeat the cycle.

2. Background Art

The conversion of chemical and thermal energy to useful mechanical and electrical energy has been studied for hundreds of years. This interest has led to some engines widely used today that accomplish this feat, well-known examples being the internal combustion engines, and gas combustion- and steam-driven turbines. Unfortunately, all technologies currently in widespread use are limited in efficiency to approximately less than 40% and are constrained in the type of fuel that can be used.

One group of engines for converting energy known variously as heat engines, caloric engines, hot air engines or external combustion engines, have seen very little application. Exemplary engines in this field are the Carnot, Stirling and Ericsson engines. While such engines in theory are capable of remarkably high efficiencies, in practice the engines have failed to reach their full potential within a reasonable cost and package.

There are several reasons why Carnot, Stirling and Ericsson cycle engines have not been proven effective or broadly commercialized. Most important is the difficulty in achieving the heat transfer required during the isothermal heat transfer processes to reach a reasonable power output within a reasonable cost and package.

Because the Stirling and Ericsson engines are closed cycles that are typically under significant pressure, problems with design and sealing abound in containing the working fluid during operation. The stringent sealing requirements of these engines tend to increase mechanical friction.

The effectiveness of the regenerator or "recuperator" used in these engines is limited. There are some indications that they save 75% of the heat during the cooling constant volume process, and return it during the constant volume heating process. Nonetheless, an effectiveness of 75% results in a significant loss of thermal energy and efficiency.

The rate of heat transfer during the isothermal heat transfer process primarily is governed by the temperature difference between the working fluid and the heat exchanger. In order to maintain sufficient heat transfer rates to accomplish a reasonable power output, it is required to have rather large temperature differences. However, increasing the temperature differences effectively causes the working fluid hot temperature to drop and the cold temperature to increase, thereby decreasing efficiency.

Moreover, the critical components in Ericsson and Stirling engines, such as valves, cylinders and pistons, are subject to extremely high temperatures. While high temperatures are regularly seen in automotive engines and turbines, the Stirling and Ericsson engines are also required to maintain extreme temperature gradients to function properly. These extreme temperature gradients as well as high temperatures require that the engine be built primarily with exotic materials.

Because exhaust or waste heat in Ericsson and Stirling engines is typically rejected through the heat exchanger during the cold isothermal heat transfer process, the cooling capabilities required to maintain the heat exchanger temperature are prohibitive. In contrast, an internal combustion engine rejects at least 50% of waste heat through the hot exhaust gases.

The mechanical configurations of Stirling engines are generally divided into three groups. They are typically called Alpha, Beta and Gamma engines, thoroughly discussed in the website www.ent.ohiou.edu/~urieli/stirling/engines/engines.html. In each of those Stirling designs, the hot exchanger, the regenerator and the cold exchanger are placed in series and in close proximity. The difficulties in thermally isolating each exchanger and preventing the heat from the hot exchanger from being transferred to the other two, and thus wasted, are well known. Additionally because they use three heat exchangers (hot, cold and regenerator), Stirling engines have excessive dead space that reduces specific power and efficiency.

SUMMARY OF THE INVENTION (DISCLOSURE OF THE INVENTION)

Against the foregoing background, the present invention was developed. Several objects and advantages of the present invention are: (1) to provide a method and apparatus for implementing a new and unique thermodynamic cycle for converting thermal energy to mechanical energy; (2) to provide an engine that can use a wide range of fuels; (3) to provide an engine that performs with a higher efficiency than is achieved with present technology; (4) to provide for power conversion in an engine which operates quietly; (5) to provide an engine design in which the sealing required is the same as in standard engine designs in current use; (6) to provide for an engine with more effective regeneration by eliminating the Stirling regenerator and replacing it with a method of regeneration in the form of isentropic compression and expansion; (7) to eliminate the need for cooling apparatus of any kind; (8) to provide for an engine in which there is only one heat exchange process required of the apparatus; (9) to provide for an engine with simpler thermal management than the Stirling engines; and (10) to provide for a method and apparatus whereby the effective cold temperature of the engine is lower than that achievable in known Ericsson or Stirling engines.

Further objects an advantages of the present invention are: (11) to provide for an engine such that very large thermal gradients across critical components need not be maintained; (12) to provide for an engine in which temperatures required of components is not significantly greater than that already achieved by standard automotive materials; (13) to provide for an apparatus whereby the dead space in the engine is smaller than standard Stirling engines; and (14) to provide an engine that achieves the above objects and advantages in a package that is small and inexpensive to build.

There is provided in accordance with the present invention a method and apparatus for converting thermal energy to mechanical energy using a unique thermodynamic cycle permitting the use of a wide range of fuels and operating at a higher efficiency than is with present art in a package that is reasonably small and inexpensive to build.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
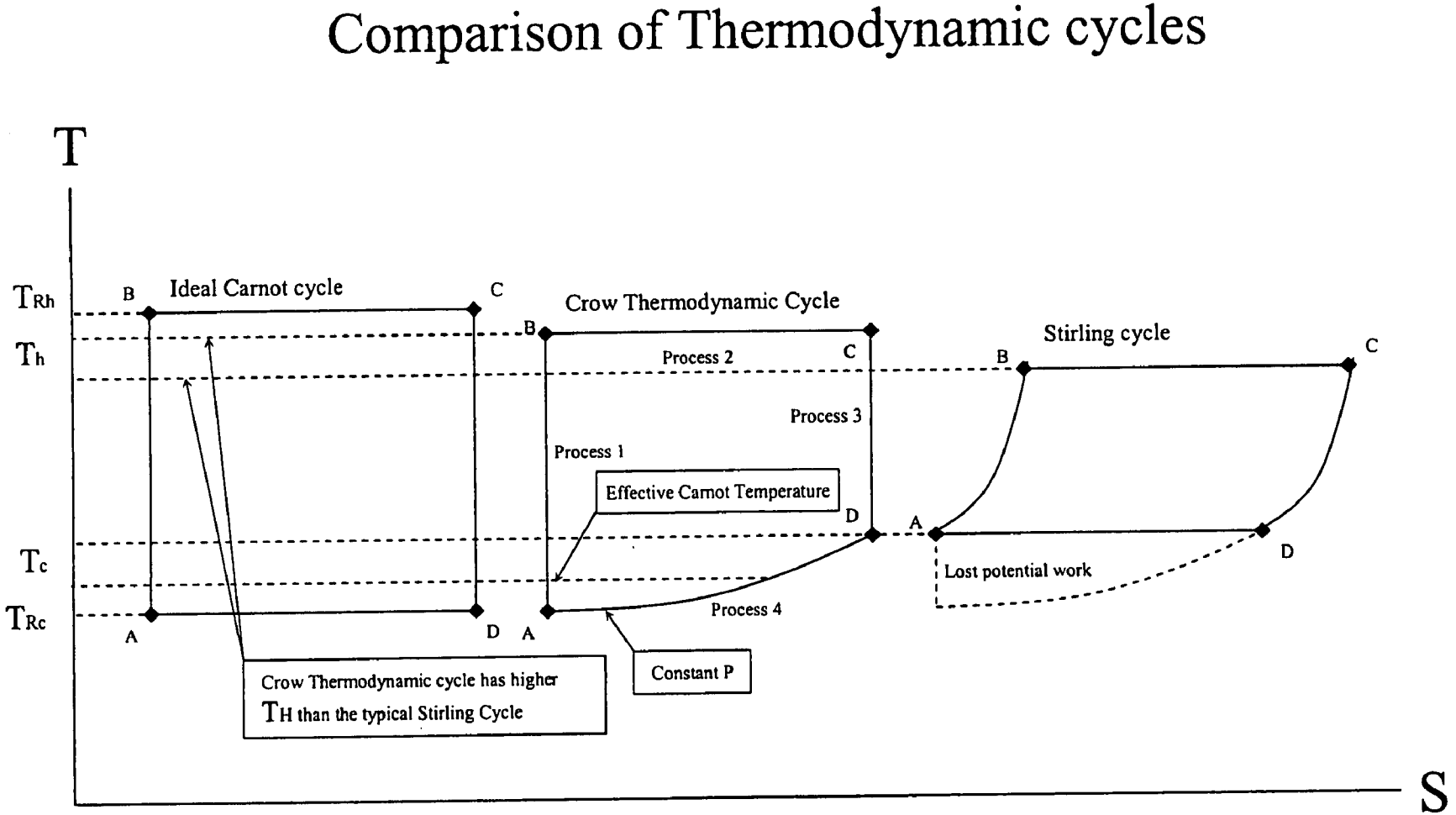
FIG. 1 is a graphical comparison of thermodynamic cycles (Ideal Carnot, Crow and Stirling) in T-S diagrams.

DESCRIPTION OF THE PREFERRED EMBODIMENTS (BEST MODES FOR CARRYING OUT THE INVENTION)

The present invention relates to an innovative apparatus and method for converting thermal energy into mechanical energy. Reference is made to a thermodynamic cycle that will sometimes be called the "Crow Thermodynamic Cycle," the "Crow Cycle" or "the subject cycle." Also in the course of this disclosure reference will be made to a number of mathematical variables. For convenience, the several variables and their meanings are set forth in Table 1.

TABLE 1

| List of Variables | |
|---|---|
| $\eta$ | Thermodynamic efficiency, as measured by total work divided by thermal heat |
| $\eta_{ideal}$ | Thermodynamic efficiency, assuming the working fluid reaches reservoir |
| $T_c$ | Low temperature reached by the working fluid during the thermodynamic cycle |
| $T_h$ | High temperature reached by the working fluid during the thermodynamic cycle |
| $T_{Rc}$ | Cold reservoir temperature |
| $T_{Rh}$ | Hot reservoir temperature |
| $T_{c,e}$ | Effective isothermal low temperature reached by the working fluid |
| $T_{h,e}$ | Effective isothermal high temperature reached by the working fluid |
| $T_A$ | Temperature at thermodynamic state A |
| $T_B$ | Temperature at thermodynamic state B |
| $T_C$ | Temperature at thermodynamic state C |
| $T_D$ | Temperature at thermodynamic state D |
| $P_A$ | Pressure at thermodynamic state A |
| $P_B$ | Pressure at thermodynamic state B |
| $P_C$ | Pressure at thermodynamic state C |
| $P_D$ | Pressure at thermodynamic state D |
| $\upsilon_A$ | Specific volume at thermodynamic state A |
| $\upsilon_B$ | Specific volume at thermodynamic state B |
| $\upsilon_C$ | Specific volume at thermodynamic state C |
| $\upsilon_D$ | Specific volume at thermodynamic state D |
| $S_A$ | Entropy at thermodynamic state A |
| $S_B$ | Entropy at thermodynamic state B |
| $S_C$ | Entropy at thermodynamic state C |
| $S_D$ | Entropy at thermodynamic state D |
| $C_r$ | Isentropic compression ratio of the working $\upsilon_A/\upsilon_B$ |
| $E_r$ | Expansion ratio; describes how much isothermal expansion occurs $\upsilon_C/\upsilon_B$ |
| $P_{net}$ | Net power output from the thermodynamic cycle |
| $Q_{in}$ | Total heat input to the thermodynamic cycle |
| $Q_{out}$ | Total heat rejected from the thermodynamic cycle ('waste heat') |
| $\Delta T$ | Temperature difference between the working fluid and the hot or cold reservoirs |
| $\Delta h$ | Change in enthalpy of a working fluid |
| $w_s$ | Shaft work put in or removed |
| h | Heat transfer coefficient used in basic heat transfer equation $Q = AhAT$ |
| ctf | "cycle time fraction": Fraction of time heat exchanger is used during engine cycle |
| $\mu$ | Thermal diffusivity of a gas |
| $\nu$ | Kinematic viscosity of a gas |
| $C_p$ | Constant pressure heat capacity of a gas |
| $Hx_v$ | Volume inside heat exchanger; 'dead volume' |
| $C_v$ | Total volume inside engine after adiabatic compression ($C_v = \upsilon_B$) |
| $\eta_{CTC}$ | Efficiency of the Crow Thermodynamic Cycle |

Thermodynamic Cycle

Figure 2:
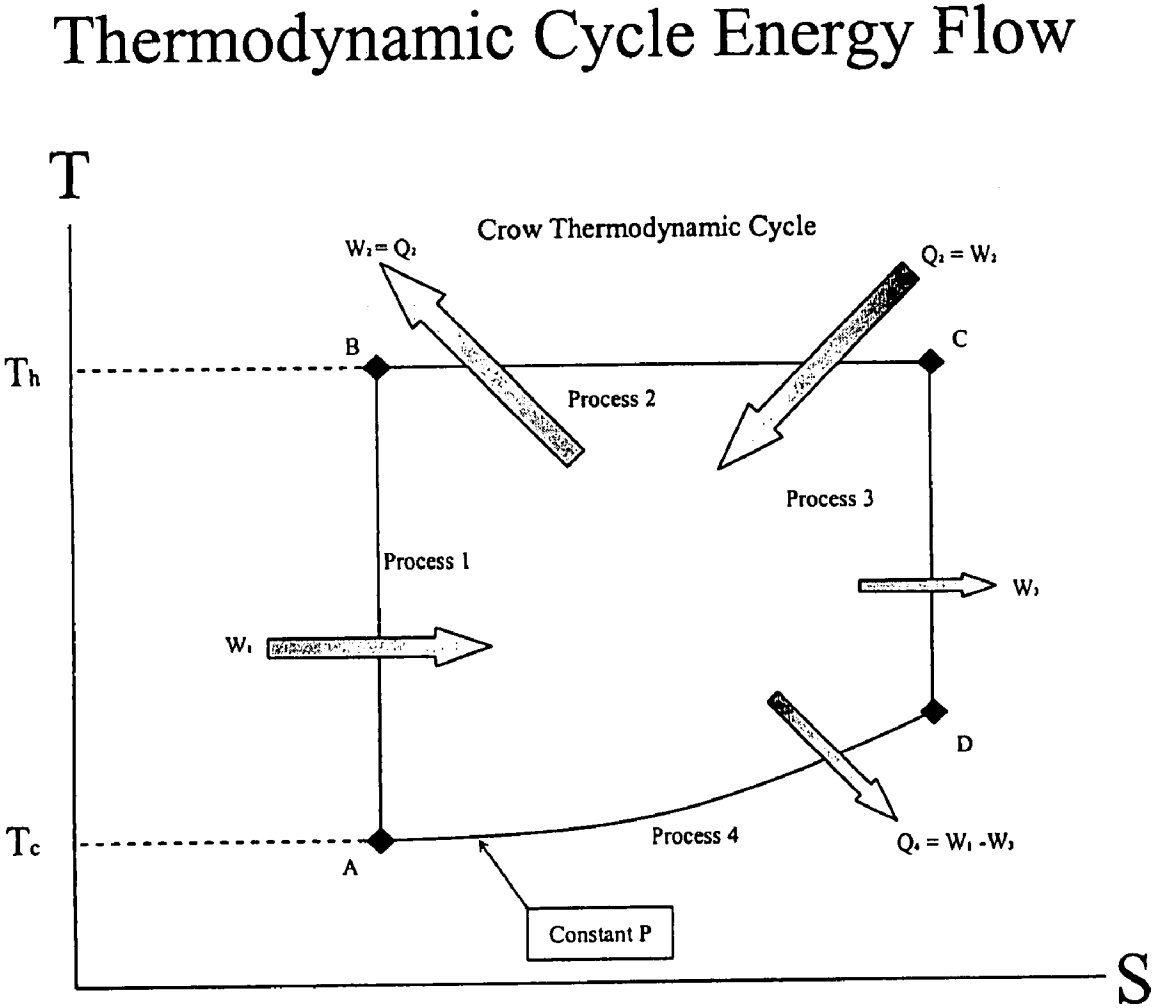
FIG. 2 is a graph showing thermodynamic cycle energy flow, using a T-S diagram.
Figure 20:
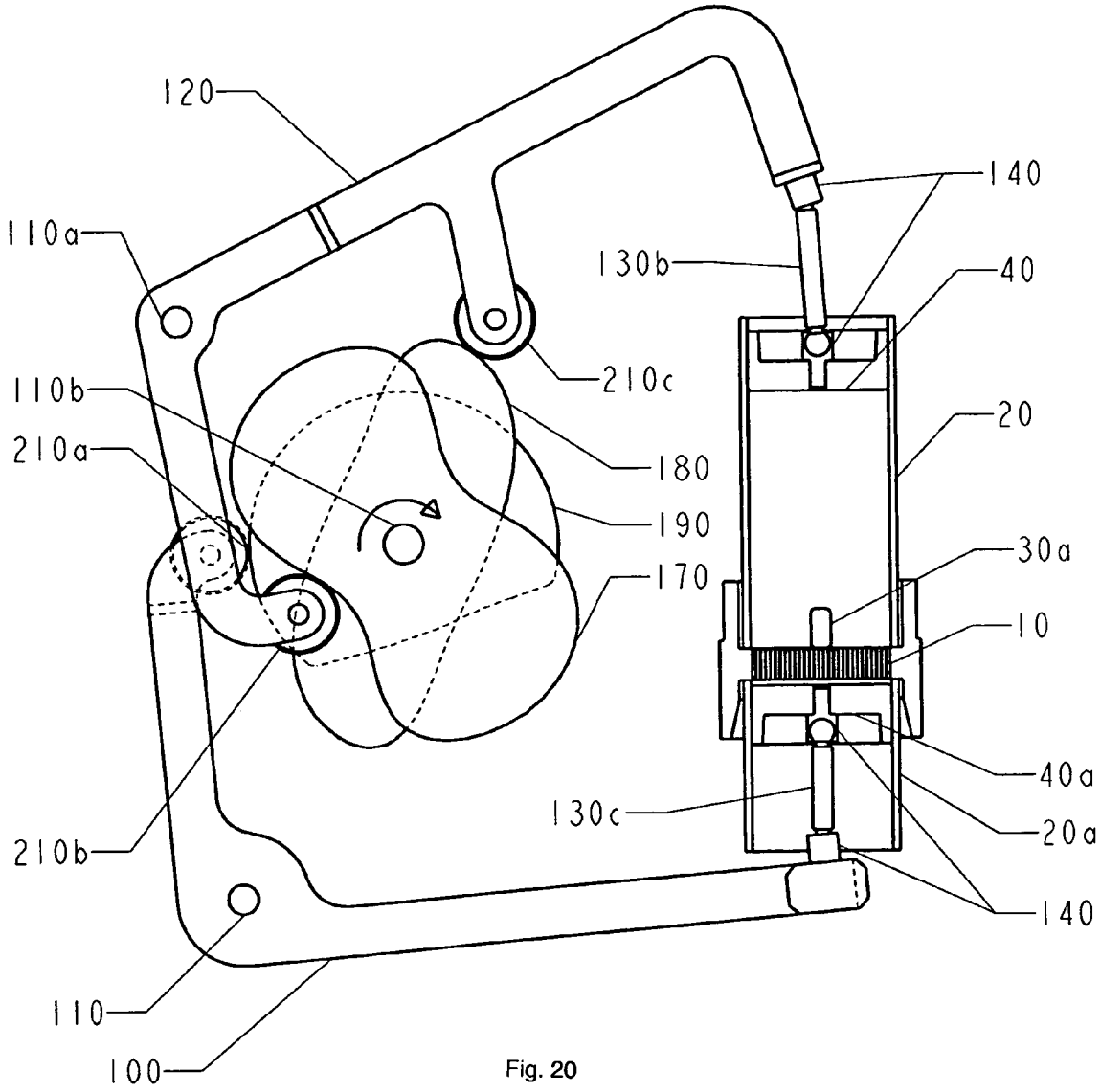
FIG. 20 is a diagrammatic side view of the embodiment of the apparatus shown in FIG. 13, detailing compression and transfer piston actuation.

A full understanding of the invention is first had with an understanding of the Crow Thermodynamic Cycle. Reference is made to FIGS. 1 and 20, where the subject cycle of the present invention is illustrated. FIG. 1 provides a comparison of an Ideal Carnot Cycle (right-hand plot on graph) and the Stirling Cycle (left-hand plot), both as known in the art, with the Crow Thermodynamic Cycle. FIG. 2 provides additional disclosure regarding the Crow Thermodynamic Cycle.

The cycle begins with a unit of working fluid at an ambient pressure and temperature A. The working fluid preferably is air, but other working fluids, including liquids, may be suited to alternative embodiments of the invention. The working fluid is then isentropically compressed to a higher temperature and pressure point B. Then, the working fluid is isothermally expanded to point C. The working fluid is then isentropically expanded to point D, such that $P_D=P_A$. Between points A and D, the working fluid is expelled to the ambient environment at constant pressure, and new working fluid is drawn in from ambient at constant pressure.

Figure 10:
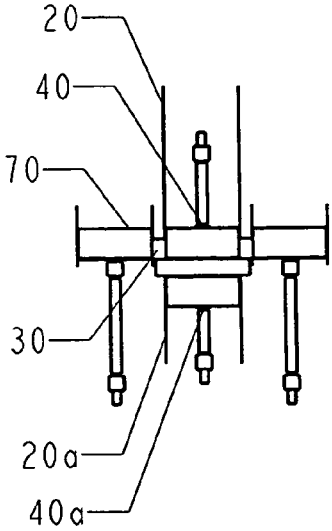
FIG. 10 is a diagrammatic side view of the engine apparatus of FIG. 40, with the engine exhaust complete and the exhaust valve closed.

Referring to FIG. 10, during Process 1 work is done by the engine on the fluid to compress it and raise the temperature adiabatically to the high temperature $T_h$. Process 1 in the subject cycle is corollary to the regenerative heating process or stage in common Stirling engines. Process 1 is followed by the isothermal expansion Process 2, whereby heat energy is added to the working fluid while work energy is simultaneously removed. Process 2 is the process whereby all gross energy is added to the engine. All thermal energy added to the working fluid is balanced exactly by the same amount of mechanical work extracted such that $\Delta h=0$.

During process 3, the working fluid is expanded adiabatically, cooling it to $T_D$ as the pressure is reduced to ambient. It is important to recognize that by expanding to $P_A$, the resulting volume $\upsilon_D$ is greater than the volume $\upsilon_A$ in state A. This results in a piston stroke that is longer than that required to intake the volume $v_A$. During Process 3, work energy is recovered from the gas as it expands and cools. Process 3 effectively recaptures as much of the energy as possible that is supplied during process 1. Process 3 of the subject cycle thus is corollary to the regenerative cooling process in conventional Stirling engines.

Notably, the rapid compression and expansion of the working fluid in Processes 1 and 3 has the major benefit of not being limited by the ability of a heat exchanger to transfer heat into or out of the fluid. Rather, the engine is only limited in the mechanical ability of the machinery. It should also be recognized that the energy not recovered in process 3 represents the Carnot inefficiency inherent in every thermodynamic cycle.

Finally, Process 4, the constant pressure heat rejection process, is achieved by simply rejecting the working gas to the environment at constant pressure, as is done in Otto and Diesel cycle engines. The overriding and distinct advantage to this process is that the engine now requires no cold heat exchanger to remove the heat from the warm exhaust air. By dumping the exhaust to ambient at an elevated temperature, the engine is using the atmosphere as a heat exchanger with infinite capacity and eliminating the need for a cooler from the design. An advantage in this change is not only in the elimination of the machinery, but also in allowing for the design of an engine with whatever exhaust temperature is desired (above ambient temperature).

Again, an advantage to this thermodynamic cycle is that no cooling is required. In fact, cooling in this engine is undesirable and should be avoided if the mechanical design and material properties allow it. The engine should be thermally insulated where possible and where materials permit in order to limit external cooling as much as possible. The only desirable heat loss in this engine is through the exhaust. Heat loss by any other path decreases efficiency.

Continuing reference is made to FIG. 10. With the preferred embodiment of the invention discussed later, the effective hot and cold temperatures for calculating Carnot efficiency $$\eta = 1 - \frac{T_c}{T_h}$$

are at least as high (hot) or low (cold) as those of a reasonable Stirling or Ericsson cycle engine.

Thermodynamic Cycle Energy Balance

Attention is invited to FIG. 20. Knowing the qualitative flow of energy into and out of the working fluid is central to understanding the Crow Thermodynamic Cycle. In the discussion of energy flows, W represents work, or mechanical energy input or extracted while Q represents heat energy input or exhausted.

During Process 1 of the subject cycle, the only energy added to the working fluid is work energy $W_1$. During isothermal Process 2, heat energy added $Q_2$ is balanced exactly by work energy extracted $W_2$. Work energy $W_3$ is recovered during Process 3. This energy can be viewed as a recovery of some of the energy added during Process 1 and is corollary to a regenerator in Stirling engines. Importantly, $W_3$ must be smaller than $W_2$. During Process 4, heat energy $Q_4$ is removed from the cycle by the exhaust.

For the energy balance to be correct, $Q_4=W_1-W_3$. Energy balance is achieved in Process 2 by $W_2=Q_2$. Since $W_3<W_1$, the net energy not recovered by $W_3$ must be removed by $Q_4$. The energy flow diagram of FIG. 2 clarifies that energy balance is achieved, where the energy flows, and where the inefficiencies in the cycle arise.

Theory Underlying Thermodynamic Cycle

The Crow Thermodynamic Cycle has been discussed hereinabove in generally qualitative terms. The following provides additional disclosure of the mathematical underpinnings and thermodynamic theory supporting the concept.

For analysis purposes is it assumed that the working fluid is air and that it behaves as an ideal gas ($P\upsilon=RT$). Additionally, the constant pressure specific heat of air $C_p$, the kinematic viscosity $\nu$ and the thermal diffusivity $\mu$ of air are all assumed constant. Over relatively small temperature differences, this assumption is reasonable.

While a discussion of key equations is in order, it suffices for this disclosure that all equations for the significant characteristics of the thermodynamic cycle can be derived from the following equations (1), (2) and (3):

$$Pv = RT \text{ (Ideal Gas Equation)} \tag{1}$$

$$\Delta s = C_p \ln\frac{T_2}{T_1} - R\ln\frac{P_2}{P_1} \tag{2}$$

(Change in Entropy assuming $C_p$ constant)

$$\Delta s = \frac{\Delta Q}{T} \tag{3}$$

The thermodynamic efficiency of the cycle is a figure of primary interest. Considering the energy flows, efficiency is defined as:

$$\text{Let } Q_2 = Q_{in}, \text{ and } Q_4 = Q_{out} \tag{4}$$

$$\eta = \frac{W_2 - Q_4}{Q_2}; \text{ Noting that } W_2 = Q_2 \text{ and reducing,} \tag{5}$$

$$\eta = 1 - \frac{Q_4}{W_2} \text{ then,}$$

$$\boxed{\eta = 1 - \frac{Q_{out}}{Q_{in}}} \text{ This is net work extracted divided by total heat input } (W_2 = Q_{in}) \tag{6}$$

$$\Delta s = \frac{\Delta Q}{T} \rightarrow \Delta Q = \Delta S \cdot T \text{ and } \Delta s = C_p \ln\frac{T_2}{T_1} - R\ln\frac{P_2}{P_1}, \tag{7}$$

$$Q_2 = T_C\left(C_p \ln\frac{T_C}{T_B} - R\ln\frac{P_C}{P_B}\right); T_C = T_B \rightarrow Q_{in} = -T_C R\ln\frac{P_C}{P_B}; E_r = \frac{P_B}{P_C} \tag{8}$$

$$\boxed{Q_{in} = T_h R\ln E_r; (T_C = T_h)} \tag{9}$$

It is noted that $T_B=T_C=T_h$. Only the high temperature and the isentropic expansion ratio $E_4$ govern the amount of energy input during process 2. The derivation for $Q_{out}$, is rather long, so much detail has been omitted:

$$Q_{out}=h_D-h_A; \text{ (h is enthalpy)} \rightarrow Q_{out}=C_p(T_D-T_A) \tag{10}$$

$$\text{Using equations (1), (2) and (3),} \tag{11}$$

$$T_D \text{ can be derived as } \boxed{T_D = T_A E_r^{R/C_p}}$$

Interestingly, the temperature at state D is dependent solely on the isothermal expansion ratio $E_r$ (given ambient temperature $T_A$ and assuming constant $C_p$). That is, the exhaust temperature for any engine regardless of $T_h$ is the same if $E_r$ is the same provided $T_h$ is higher than ambient temperature. In this way, $E_r$ can be tailored to achieve whatever exhaust temperature is desired. While this seems unlikely, it can be understood in that $E_r$ can be seen as a measure of the increase in entropy. Understanding that increasing entropy reduces efficiency in any thermodynamic cycle, one would expect then that $T_D$ (determinant in efficiency) should be governed by the $E_r$, a measure of increase in entropy. Assuming constant $C_p$ in the vicinity of the temperature it's calculated in, $$Q_{out} = T_A\left(C_p E_r^{R/C_p} - C_p\right) \tag{12}$$

$$\text{Equation (6)} \rightarrow \eta = 1 - \frac{Q_{out}}{Q_{in}} \tag{13}$$

$$\eta_{CTC} = 1 - \frac{T_A}{T_h} \cdot \frac{\left(C_{pD} E_r^{R/C_{pAB}} - C_{pA}\right)}{R \ln E_r} \tag{14}$$

(Crow Thermodynamic Cycle efficiency)

The derived efficiency is quite close to that of the Carnot efficiency, $$\eta = 1 - \frac{T_c}{T_h}.$$

The portion of the equation with $E_r$ in it is a function of $E_r$ only. Therefore, the Crow Thermodynamic Cycle efficiency $\eta_{CTC}$ is the Carnot efficiency with a function of $E_r$ as a slight reduction. Interestingly, if one solves $$\eta_{CTC} = 1 - \frac{T_{c,e}}{T_h}$$

for the effective Carnot cycle low temperature $T_{c,e}$, one finds that $T_A < T_{c,e} < T_D$, with $T_{c,e}$ falling nearly in the middle of $T_A$ and $T_D$. (Importantly, the above equation for thermodynamic efficiency does not take into account the various inevitable losses arising from the machinery employed to utilize the thermodynamic cycle.)

The significance of this result is that although the exhaust temperature $T_D$ may be some value above the ambient temperature, by exhausting it to the ambient rather than cool it using a heat exchanger, the effective cold temperature $T_{c,e}$ is decreased from $T_D$. This decrease serves to increase efficiency as compared to if the engine cooled the air isothermally at $T_D$. The importance of this is clear when one considers that a typical Stirling engine would likely be cooled at $T_D$ or higher. The difficulty in achieving ever lower $T_c$ cannot be exaggerated. While it may be possible that the $T_c$ of a Stirling or Ericsson is lower than $T_D$, it is very unlikely that it would be lower than $T_{c,e}$. In effect, the $T_{c,e}$ can be seen as a free increase in efficiency achieved by rejecting the warm exhaust to the environment rather than cooling the working fluid with added machinery.

Net power output per cycle is $W_{net}$, $$W_{net} = Q_{in} - Q_{out} \text{ or } W_{net} = Q_{in} \cdot \eta \tag{15}$$

$$W_{net} = T_h R \ln E_r - T_A\left(C_{pD} E_r^{R/C_{pAB}} - C_{pA}\right) \tag{16}$$

Equation (16) shows the net power output per cycle, but it also shows which variables can be tweaked in the thermodynamic cycle to increase power output per cycle. Specifically, there are three variables affecting power output. $T_h$ can be increased to improve power output. $T_A$ can be reduced to improve power, but since this cycle is assumed to utilize ambient air for $T_A$, this variable is not within the control of the designer. It is unlikely that any engine design can rely on a temperature below ambient since all waste heat is eventually rejected to the atmosphere. Finally, $E_r$ can be increased to increase power output per cycle. Note that increasing $T_h$ and decreasing $T_A$ both increase efficiency while increasing $E_r$ actually decreases efficiency.

While $E_r$ can be modified to tailor the output per cycle, it must be understood that the adjustment affects only the output per thermodynamic cycle. That is, it does not necessarily increase the actual engine net engine power output. If $E_r$ is increased, then $Q_{in}$ has also increased. Consequently, the amount of heat transferred through the heat exchanger per cycle has increased. The heat flux through the heat exchanger is essentially limited by temperature between the hot reservoir and the heated working fluid. As a result, the amount of time for the heat transfer must likely also increase. This results in a slower engine speed, fewer power cycles per second, and hence a small change if any in net power output. Additionally, increasing $E_r$ reduces efficiency. The various equations and energy losses must be balanced to achieve the optimal engine operating regime.

Decreasing $E_r$ of course, increases efficiency. If $E_r$ is allowed to be too small, the efficiency is maximized but the amount of heat transfer per cycle is so small that the cycle speed of the engine must be increased. This causes excessive pumping losses in moving the air into and out of the engine as well as excess mechanical friction. The optimal $E_r$ for the engine design therefore must be tailored to meet the constraints presented by pumping losses in the valving, heat transfer capability of the heat exchanger, etc.

Using equations (2) and (3), the pressure at state B $P_B$ and the Compression ratio during process 1 $C_r$ are calculated, $$P_B = P_A\left(\frac{T_B}{T_A}\right)^{C_{pAB}/R} \tag{17}$$

$$C_r = \frac{T_A}{T_B}\left(\frac{T_B}{T_A}\right)^{C_{pAB}/R} \tag{18}$$

Increasing $T_h$ ($T_h = T_B$) is the most effective method of increasing power output per cycle, as doing so also increases efficiency of the cycle. However, material and design limitations are expected to constrain $T_h$. See equations (17) and (18). As temperature increases, the resulting pressure $P_B$ required increases exponentially as does the compression ratio $C_r$. The exponential increase in pressure is clearly a difficult limitation to overcome. The compression ratio seems to be less of an obstacle until one realizes that at extremely high temperatures of say 1000C, a compression ratio of sixty (60) may be needed.

It appears an easily achievable value for $T_h$ is probably around 550° C. resulting in a reasonable $P_B$ of about 610 psi and a $C_r$ of about 15. With an expansion ratio $E_r$ of five (5), the resulting thermodynamic efficiency is about 54% This represents an enormous gain over known and available technologies. Upon finding a reasonable engineering solution to reaching a $C_r$ of sixty-one (61), the resulting pressure $P_B$ would be 3800 psi, $T_h$ would be 1000° C. and with an $E_r$ of ten (10), the resulting thermodynamic efficiency could approach 69%. Naturally, higher temperatures achieved by the engine result in higher efficiencies and higher power output.

While the thermal efficiencies used here are examples that would not be achieved in net efficiency due to friction and pumping losses, it is expected that the mechanical design is very efficient such that at least 90% of thermodynamic efficiency is reached.

Notably, the thermodynamic theory does not account for other obvious means of increasing engine net power output. Although increasing $T_h$ presents problems, the temperature of the hot supply reservoir $T_{Rh}$, can be increased to increase power output. Larger temperature differences between $T_{Rh}$ and $T_h$ cause a greater heat transfer rate. Raising $T_{Rh}$ is not expected to be as difficult as increasing $T_h$ because the hot reservoir is expected to be either a combustor/furnace or solar concentrator or some other device where temperatures of existing designs already often far exceed the temperatures of a piston type engine. It is expected that the reservoir temperature can be kept very high while keeping the temperature sensitive components of the engine shielded from excessive heat.

Increasing $T_{Rh}$ can have an additional benefit of indirectly increasing efficiency. If the designer wishes to maintain the same net power output, the efficiency can be increased. If the heat transfer rate is increased by increasing $T_{Rh}$, then the incremental power output per cycle can be reduced by decreasing $E_r$ and running the engine faster (completing each cycle more quickly). As seen in equation (14), a decrease in $E_r$ increases efficiency. Therefore, by increasing the rate of heat transfer, $E_r$ can be decreased and $\eta_{CTC}$ is increased. Of course there is a limit to this, where pumping losses through the valves will draw excessive energy from the engine at engines speeds that are too high. The essential effect of increasing $T_{Rh}$ is to simply allow the engine to run at higher speeds and greater efficiencies or at the same speed and higher power, all other design variables being equal.

It is observed that the isothermal Process 2 is the only time the engine is receiving energy. As such, it is natural that the desired operation is to have the isothermal Process 2 be as long as possible. Therefore, a variable ctf, cycle time fraction, is defined. The cycle time fraction is the fraction or percentage of the total thermodynamic cycle time taken up by thermodynamic Process 2. It should be clear that every increase in ctf results in a commensurate increase in net power output of the engine, because the heat exchange device is now in contact with the working medium for a longer period of time, allowing for ever more heat transfer into the air. While in theory, a ctf of up to 90% might be possible, it is believed that the practical limit is most likely in the region of 50%. Excessive ctf will likely result in excessive pumping losses as the air is forced out of and sucked into the engine at very high rates. The value for ctf has to be balanced against the pumping losses experienced in the engine to arrive at the optimal operating regime.

Engine Apparatus Design and Operation

Having provided a teaching of the theoretical foundations of the invention, a description of apparatus according to the invention is now supplied. Referring to FIG. 40, the engine is illustrated as an open cycle reciprocating air engine with the principal components and features required to embody an engine exploiting the Crow Thermodynamic Cycle.

The engine comprises a flow-through energy-inputting heat exchanger 10 which has a large surface area exposed to the working fluid, good heat conduction properties, and allows for minimal pressure losses due to working fluid flowing there-through.

A compression cylinder 20 is attached to the top of heat exchanger 10, said cylinder having a hole or slot cut in each side at the bottom forming an intake port 30 on one side and an exhaust port 30*a* on the other. Compression cylinder 20 is attached to heat exchanger 10 using an appropriate adhesive or sealing compound such that it forms a seal preventing working fluid from leaking from the connection between the heat exchanger 10 and cylinder 20.

A compression piston 40 fits slidably inside the compression cylinder 20, forming a compression chamber 50 within the cylinder and above the heat exchanger 10. The compression piston 40 fits within compression cylinder 20 such that it forms a seal with said cylinder restricting working fluid leakage from compression chamber 50. Compression piston 40 can reciprocate within compression cylinder 20.

A transfer cylinder 20*a* is attached to the bottom of heat exchanger 10. Transfer cylinder 20*a* is attached to heat exchanger 10 using an appropriate adhesive or sealing compound such that it forms a seal preventing leakage from between heat exchanger 10 and transfer cylinder 20*a*. A transfer piston 40*a* fits slidably inside of transfer cylinder 20*a*, forming a transfer chamber 50*a* within the cylinder and above the heat exchanger. The transfer piston 40*a* fits within transfer cylinder 20*a* such that is forms a seal with said cylinder restricting leakage from compression chamber 50*a*. Transfer piston 40*a* is capable of reciprocating motion within transfer cylinder 20*a*.

Compression piston 40 and transfer piston 40*a* function as driving members by which mechanical energy is transmitted from the system. Expansion of working fluid in the compression cylinder 20 and/or the transfer cylinder 20*a* drives the pistons 40, 40*a* to move within their respective cylinders, and the moving pistons are operatively connected to, for example, a driveshaft or any other suitable means adapted to convert the reciprocation of the pistons into useable mechanical energy. It should be noted that the pistons 40 and 40*a* may be moving simultaneously during the practice of the invention. The practicing of the invention involves, among other things, the expansion of the total volume enclosed by the cylinders 50 and 50*a*, as well as the contraction of that volume, which may be accomplished by moving either one, of the pistons 40 or 40*a* within its corresponding cylinder while maintaining the other piston motionless, or by moving both pistons simultaneously (although not necessarily of the same length of time).

Figure 4:
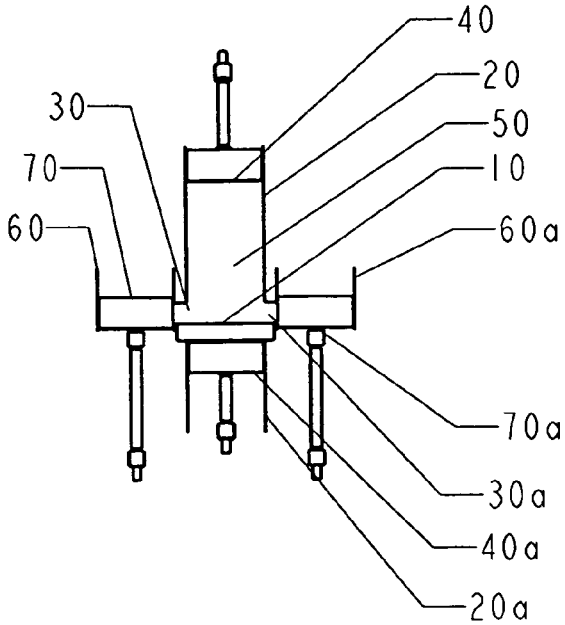
FIG. 4 is a diagrammatic side view of an engine apparatus according to the present invention, shown at the beginning of a cycle.

An intake valve cylinder 60 and an exhaust valve cylinder 60*a* are attached to opposing lateral sides of the heat exchanger 10 and compression cylinder 20, as seen in FIG. 4. Cylinders 60 and 60*a* have an aperture or slot cut in their sides, these apertures being aligned with corresponding apertures cut in compression cylinder 20, forming intake port 30 and exhaust port 30*a*, respectively. An appropriate adhesive sealing compound is used to attach cylinders 60 and 60*a* to heat exchanger 10. The intake valve cylinder 60 and the exhaust valve cylinder 60*a* thus are in fluid communication with the compression chamber 50.

An intake valve piston 70 and an exhaust valve piston 70*a* fit slidably within their respective cylinders 60 and 60*a*. The valve pistons fit within their respective valve cylinders such that they form seals with said cylinders restricting leakage from compression chamber 50. The placement of the valve ports 30, 30*a* is taken to be most beneficial when located as near as possible to the heat exchanger 10. Spatially separating the intake from the exhaust valve prevents warm exhaust air from being drawn in during the intake process. However, in alternative embodiments the valve ports can also be placed further away from the heat exchanger.

The intake valve cylinder 60 and the intake valve piston 70 in combination effectively function as an intake valve means for the compression chamber 50. Accordingly, a means for drawing the working fluid into the compression chamber 50 includes this intake valve means (in fluid communication with the compression chamber) movable between a closed condition and an open condition for allowing, e.g., ambient air into the compression chamber. Similarly, the exhaust valve cylinder 60*a* and the exhaust valve piston 70*a* constitute an exhaust valve means, whereby at least a portion (preferably all) the unit mass of working fluid can be discharged from the compression chamber 50. So, this means for exhausting at least a portion of the unit mass includes this exhaust valve means (in fluid communication with the compression chamber), movable between a closed condition and an open condition for allowing working fluid to exhaust from the compression chamber.

The connection and drive of the pistons 40, 40*a* of the engine are not shown in these figures, but are discussed in association other embodiments. The inventive engine should not be taken to be limited to a particular drive and/or connection method, but may employ any of various connection and drive train components known in the art.

Attention is invited to FIGS. 3-12, collectively, illustrating the basic operation of the engine according to the present invention. FIGS. 1 and 2 are particularly useful when considered in view of the information provided in FIG. 3.

Figure 3:
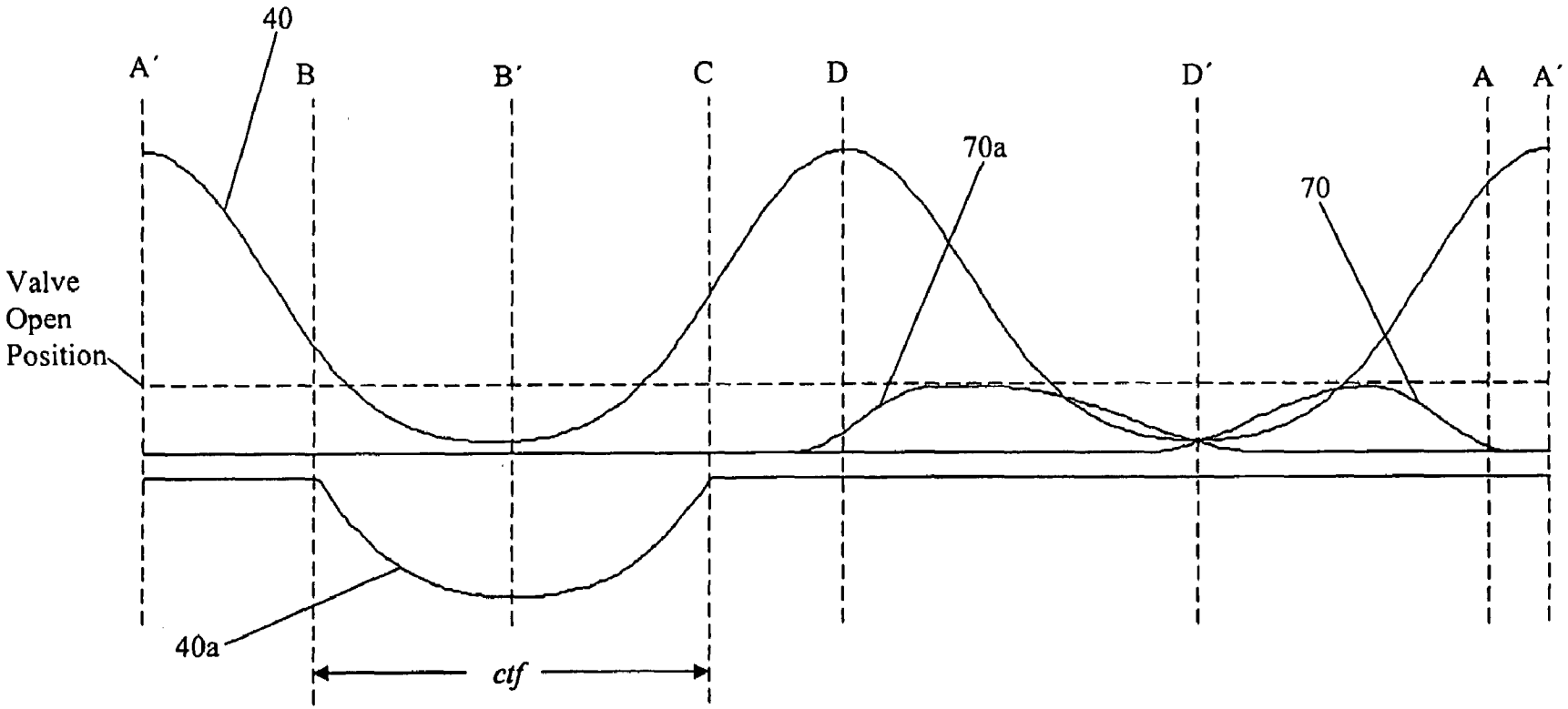
FIG. 3 is a graphical timing diagram of the engine apparatus according to the invention.

FIG. 3 shows graphically one variation of timing and motion of the compression piston 40, transfer piston 40*a* and the intake and exhaust valve pistons 70 and 7*a*. Points A, B, C and D (on FIG. 3) correspond to the thermodynamic states represented in FIGS. 1 and 2. A', B' and D' represent intermediate points in the subject thermodynamic cycle.

FIG. 4 shows the engine at cycle point A' in FIG. 3. At this point working fluid, preferably fresh cool ambient air, has been drawn into the compression chamber 50 by action of drawing the compression piston 40 upward with intake port 30 simultaneously open. The enclosed volume has been drawn into a slight vacuum, due to thermodynamic cycle states A and D being different volumes. After a small movement downward by piston 40, the vacuum is extinguished. Compression piston 40 then begins isentropic compression of the working fluid to point B. By virtue of the apparatus design, some working fluid is pushed into the heat exchanger, but this is not considered a desirable aspect.

Figure 5:
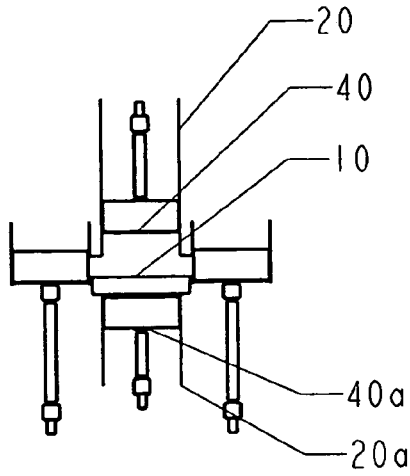
FIG. 5 is a diagrammatic side view of the engine apparatus of FIG. 40, shown at the end of the isentropic compression portion of a cycle.

FIG. 5 isentropic compression to state B (at a higher temperature and a higher pressure relative to state A) is complete. Note that the working fluid temperature now is $T_B$, corresponding to the working fluid hot temperature $T_h$. At this point transfer piston 40*a* begins to draw away from heat exchanger 10, thus pulling the working fluid through the heat exchanger and causing convective heat transfer from heat exchanger 10 to the working fluid. This is the beginning of the isothermal heat transfer and expansion process. During this phase of the isothermal expansion process, compression piston 40 moves to push some, preferably all, the unit mass of working fluid past the heat exchanger 10.

Figure 6:
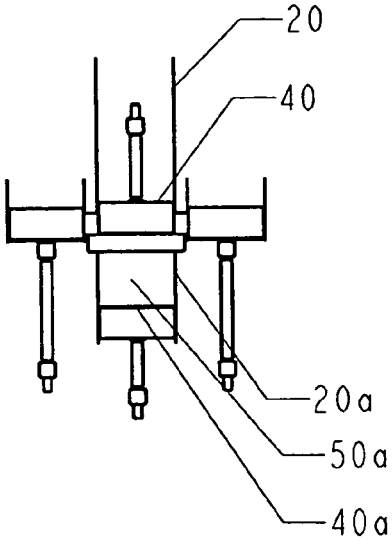
FIG. 6 is a diagrammatic side view of the engine apparatus of FIG. 40, shown at bottom dead center during the isothermal expansion portion of a cycle.

FIG. 6 depicts the transfer piston 40*a* at bottom dead center, corresponding to condition point B' in FIG. 3. The isothermal heat transfer and expansion process is approximately half completed. The total volume enclosed by the pistons and cylinders is larger than that of FIG. 5. At this point, most, preferably all, the unit mass of working fluid has moved past the heat exchanger 10 and is enclosed within the transfer chamber 50. Some of the unit mass is also contained within the heat exchanger dead volume (heat exchanger passageways 250). Because the heat exchanger 10 is operatively disposed between the compression chamber 50 and the transfer chamber 50*a*, the heat exchanger imparts thermal energy to the working fluid while some or all the unit mass of fluid is moving past the heat exchanger (under the urging of the compression piston 40). Thus, the expansion of the working fluid (such as air) is matched by a corresponding transfer of heat into the working fluid from the heat exchanger 10 such that the temperature of the working fluid does not significantly change. The energy gained by the engine during this phase is provided by the connection of the transfer piston 40*a* to the drive means.

Figure 7:
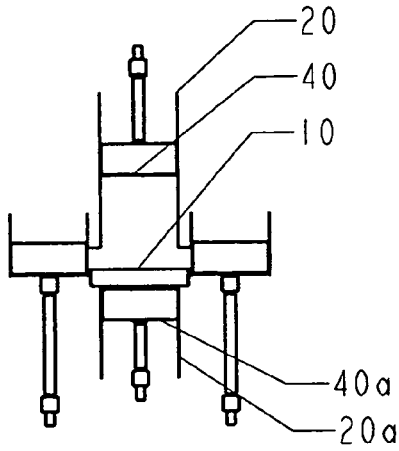
FIG. 7 is a diagrammatic side view of the engine apparatus of FIG. 40, shown at the end of the isothermal expansion portion of a cycle.
Figure 8:
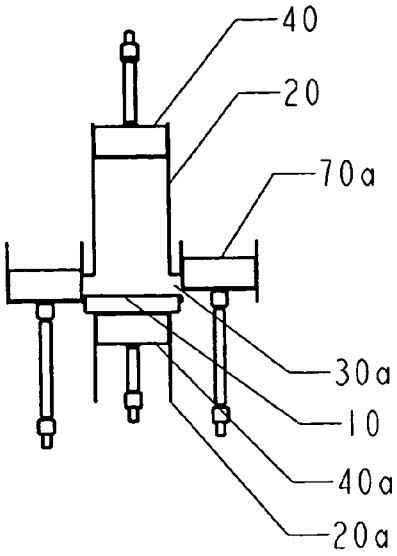
FIG. 8 is a diagrammatic side view of the engine apparatus of FIG. 40, shown at the end of isentropic expansion, as the exhaust valve opens.

Referring to FIG. 7, the engine is shown at the end of the isothermal expansion process, C, with the unit mass of working fluid at a first subsequent volume. During this process wherein the compression piston 40 is moving away from the heat exchanger, the compression piston 40 is receiving energy and transmitting it via the drive means to the output shaft. The engine at this state has received all gross energy from the energy source for the cycle. The time between points B and C is the "cycle time fraction," as graphically illustrated in FIG. 3. At this point in the cycle, isentropic expansion to a second subsequent volume begins. FIG. 8 shows the engine at the end of isentropic expansion, condition point D, with the unit mass at the second subsequent volume. The engine has recouped as much of the compression energy from Process 1 as possible. Because the compression chamber 50 is closed by the transfer piston 40 and transfer cylinder 20, the compression piston is seen to be slidably drivable by a unit mass's expansion in the compression chamber 50*a*. At the end of isentropic expansion, the pressure inside the compression chamber 50 is equal to ambient pressure. At this time, the exhaust piston 70*a* has moved slightly such that the exhaust port 30*a* is slightly open, and the exhausting of the working fluid begins.

Figure 9:
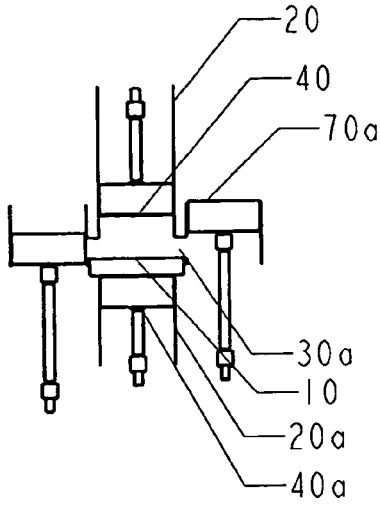
FIG. 9 is a diagrammatic side view of the engine apparatus of FIG. 40, shown at the end of isentropic expansion with the exhaust valve fully open.
Figure 11:
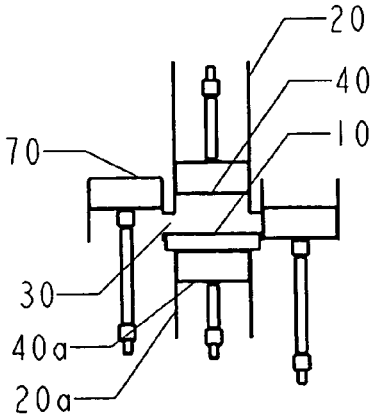
FIG. 11 is a diagrammatic side view of the engine apparatus of FIG. 40, shown with the intake valve fully open to intake fresh air.

Turning to FIG. 9 it is seen that the exhaust port 30*a* is fully open and the compression piston 40 is in the act of expelling the exhaust fluid (air) to the ambient environment. It is recognized that some heat transfer from the top of the heat exchanger 10 with this design is inevitable yet undesirable during the intake and exhaust flows. FIG. 10 shows the exhausting of the working fluid completed with the compression piston 40 at bottom dead center, shown by D in FIG. 3. An intake draw of fresh ambient working fluid is ready to begin, as the intake port 30 is opened by action of the intake valve piston 70 moving upwards. Concurrently, the retraction of the compression piston 40 serves to draw fresh fluid into the compression chamber 50. FIG. 11 shows the intake port 30 in full open condition, and the compression piston 40 moving upward to draw in ambient air.

Figure 12:
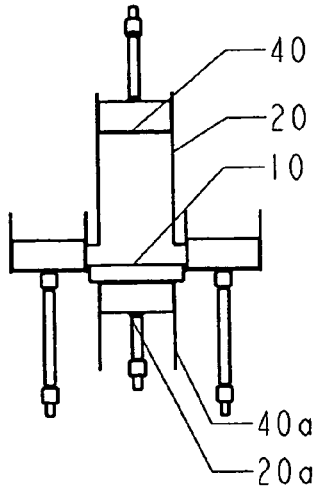
FIG. 12 is a diagrammatic side view of the engine apparatus of FIG. 40, shown with the intake complete but the compression piston not yet at top dead center.

FIG. 12 shows the intake process complete, the intake valve in a closed condition and the engine at state A (FIG. 3). After this point the compression piston 40 continues to retract or withdraw away from the heat exchanger 10, increasing the total enclosed volume and drawing a slight vacuum because $\upsilon_D > \upsilon_A$. The next state is shown again by FIG. 4, and therefore one full engine cycle is complete.

It is seen therefore, that the intake valve port 30 provides fluid communication between the compression chamber 50 and the interior of the intake valve cylinder 60 while the exhaust valve port 30*a* provides fluid communication between the compression chamber 50 and the interior of the exhaust valve cylinder 60*a*. The intake valve piston 70 is slidable within the intake valve cylinder 60 between an open position wherein the intake valve piston is removed from (does not cover or close) the intake valve port 30, and a closed position wherein the intake valve piston covers the intake valve port. Similarly, the exhaust valve piston 70*a* is slidable within the exhaust valve cylinder 60*a* between an open position in which the exhaust valve piston is removed away from the exhaust valve port 30*a*, and a closed position in which the exhaust valve piston covers the exhaust valve port.

Further description of a preferred embodiment of the engine of the present invention, detailing the design, drive mechanisms and interconnections required to accomplish the motion and action required, is provided in light of FIGS. 13-21.

Figure 13:
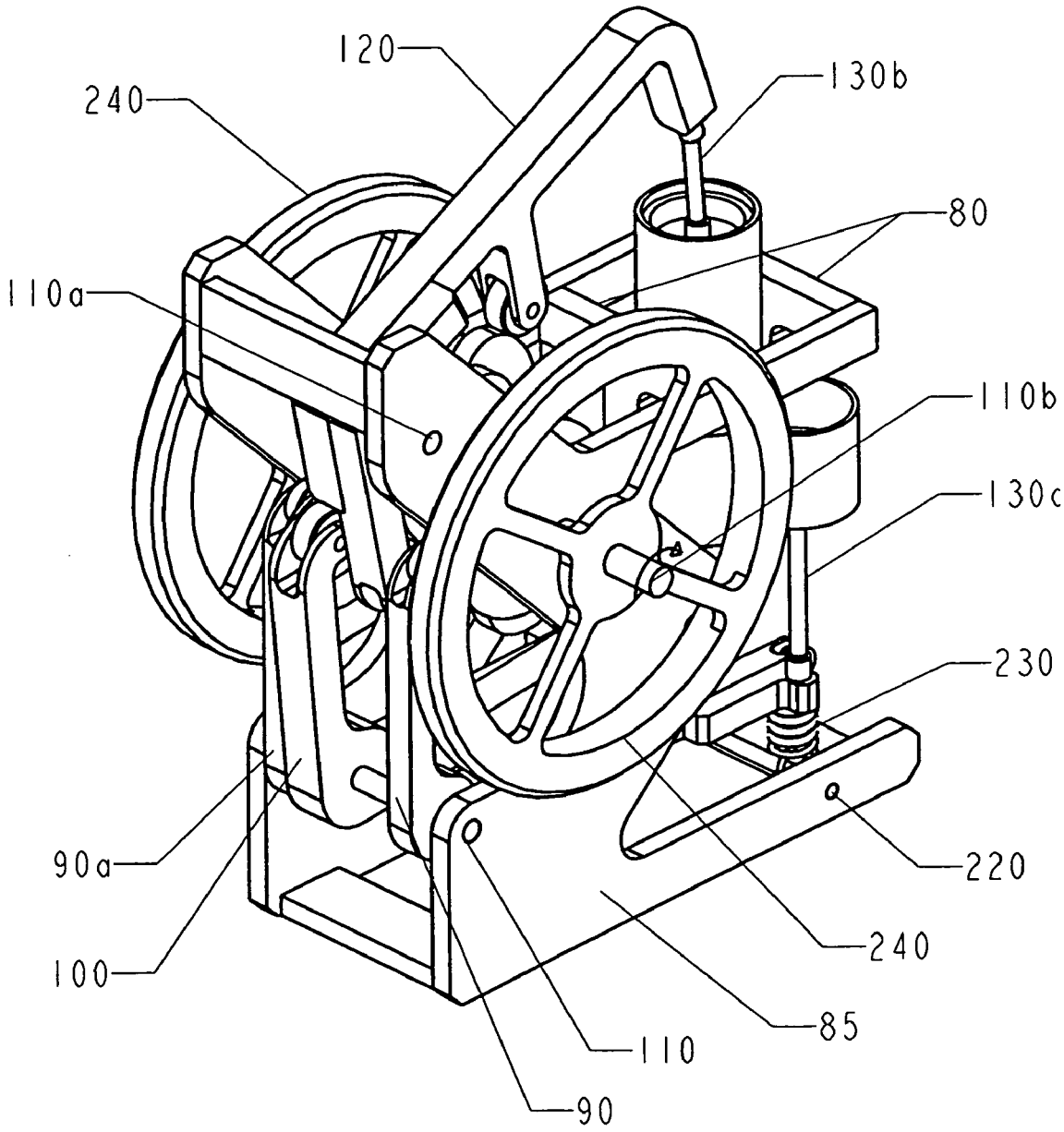
FIG. 13 is a perspective view, from the right side and above, of one embodiment of the engine apparatus according to the present invention.
Figure 14:
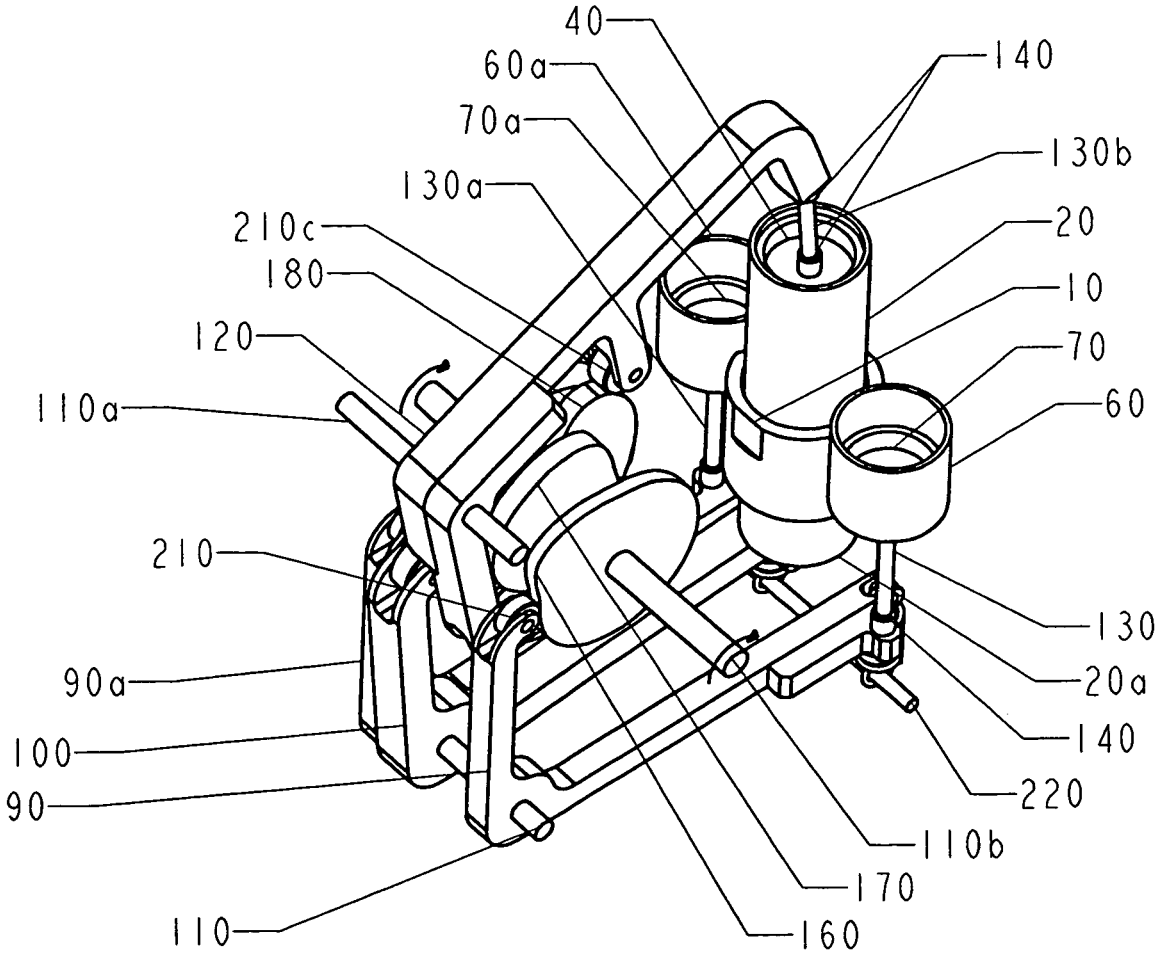
FIG. 14 is another perspective view of the embodiment of the apparatus depicted in FIG. 13, shown with the frame removed.
Figure 15:
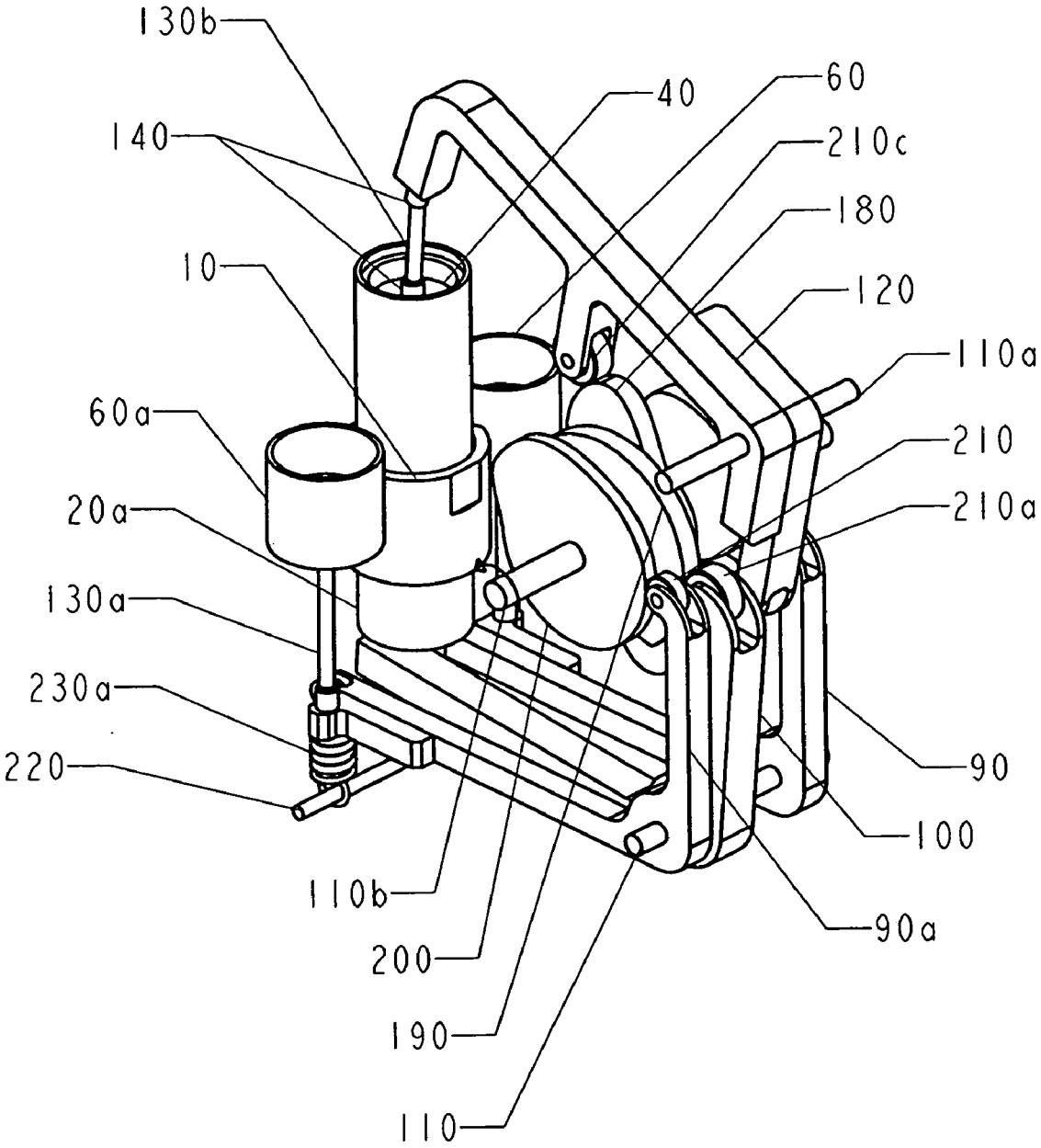
FIG. 15 is another perspective view, from the left side, of the embodiment of the apparatus depicted in FIG. 13, shown with the frame removed.
Figure 16:
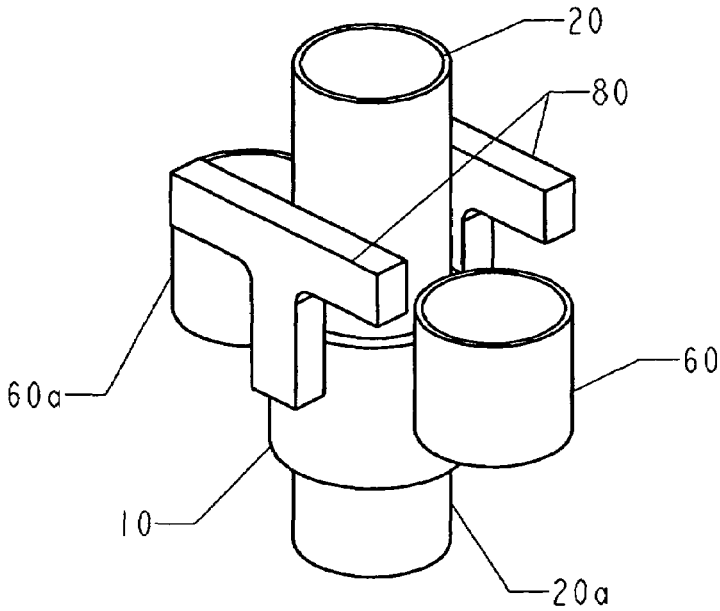
FIG. 16 is an enlarged perspective diagram of a portion of the embodiment of the apparatus depicted in FIG. 13, showing details of the heat exchanger and cylinders assembly of the apparatus of the invention.

Referring to FIG. 16, heat exchanger mount brackets 80 are attached to the sides of heat exchanger 10. Cylinders 20, 20*a*, 60 and 60*a* are attached to heat exchanger 10 as previously described, with the compression cylinder 20 and transfer cylinder 20*a* on opposite sides of the heat exchanger 10. The engine has a frame 85 with heat exchanger 10 mounted thereto by brackets 80, as depicted in FIG. 13. Referring to FIGS. 14 and 15, there are a plurality of L-shaped levers 90, 90*a* and 100 pivotally attached to the frame by a valve axle 110. The levers have rotational freedom about valve axle 110, for independent pivotal motion on the frame 85. A power lever 120 is connected to frame 85 by a compression axle 110*a*. The power lever 120 has rotational freedom about compression axle 110*a*, and thus also may pivot on the frame 85.

A valve push rod 130 with a ball and socket joint 140 on each end connects the intake valve piston 70 to intake valve lever 90, as seen in FIG. 14. A valve push rod 130*a* with a ball and socket joint 140 on each end connects exhaust valve piston 70*a* to exhaust valve lever 90*a*, as best illustrated in FIG. 15. Referring to FIG. 20, it is seen that a transfer push rod 130*c* with a ball and socket joint 140 on each end connects the transfer piston 40*a* to the transfer lever 100. Combining reference to FIGS. 14 and 15, it is seen that a compression push rod 130*b*, also with a ball and socket joint 140 on each end thereof, connects compression piston 40 to power lever 120.

Figure 17:
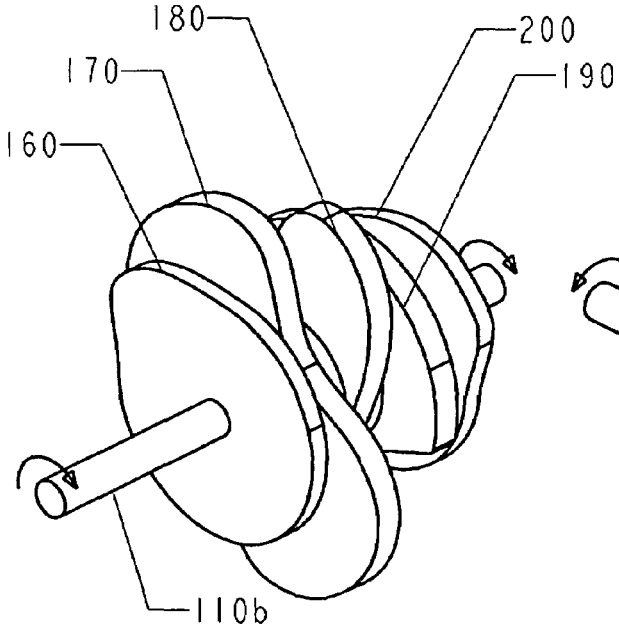
FIG. 17 is an enlarged perspective diagram of a portion of the apparatus depicted in FIG. 13, showing details if the cam drive assembly of the apparatus.
Figure 18:
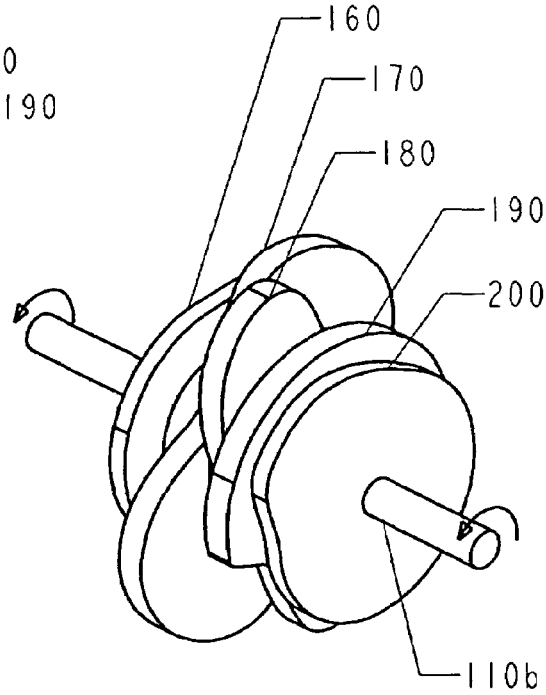
FIG. 18 is an enlarged perspective diagram of a portion of the apparatus depicted in FIG. 13, showing the opposite side from that seen FIG. 17, illustrating details if the cam drive assembly of the apparatus.

FIGS. 17 and 18 illustrate a cam drive assembly 150 that includes an intake valve cam 160, a compression push cam 170, a compression retract cam 180, a transfer cam 190 and an exhaust valve cam 200, all rigidly affixed upon a cam axle 110*b*. The cam drive assembly 150 includes the cam drive axle 110*b*, by which the cam assembly is attached to the frame 85. The plurality of cams is mounted on the axle 10*b* for rotation at a uniform angular velocity. The power takeoff for the engine is through the drive axle 110*b*.

Returning to FIGS. 14 and 15, intake valve lever 90 includes a valve roller 210 attached thereto. Intake valve lever 90 is connected to intake valve cam 160 by means of the valve roller 210. Exhaust valve lever 90*a* similarly has another valve roller 210 attached thereto. Exhaust valve lever 90*a* is connected to exhaust valve cam 200 by means of this second valve roller 210. Accordingly, the intake valve cam 160 is in rolling contact with said intake valve roller 210, the exhaust valve cam 200 is in rolling contact with the exhaust valve roller 210, the transfer cam 190 has rolling contact with the transfer roller 210*a*, and the compression push cam 170 is in rolling contact with the power push roller 210*b* while the compression retract cam 180 is in rolling contact with the power retract roller 210*c*.

Referring again to FIG. 20, transfer lever 100 has a transfer roller 210*a* attached thereto. Transfer lever 100 is operatively connected to the transfer cam 190 by the transfer roller 210*a*. The power lever 120 has a push roller 210*b* attached thereto. Power lever 120 is connected to power push cam 170 by the valve roller 210*b*. Power lever 120 also has a retract roller 210*c* attached thereto. Power lever 120 is connected to retract cam 180 by retract valve roller 210*c*. Thus, the power lever 120 is driven by two cams and rollers in order to suitably control the motion of power piston 40. Push cam 170 is used to push the piston 40 during compression and exhaust, as well as serve as the power takeoff cam during isothermal and isentropic expansion. The retract cam 180 retracts the compression piston 40 during the intake of working fluid. Each of the cams 160, 170, 180, 190, and 200 defines an eccentric profile, as seen in FIGS. 17 and 18, with the compression push cam 170 featuring a sort of figure-eight peripheral contour. With rotary motion of the cam drive axle 110*b*, the concomitant rotation of any one of the cams 160, 170, 180, 190, and 200 induces pivotal movement in a corresponding one of the levers 90, 90*a*, 100, or 120.

All the rollers 210, 210*a*, 210*b*, and 210*c* are rotatably disposed upon their respective levers 90, 90*a*, 100, 120 so to be able to free wheel in relation to the levers.

A valve spring shaft 220 is attached to frame 85, as illustrated in FIG. 13. An extension valve spring 230 with loop ends is attached thereto and connects the intake valve lever 90 to frame 85 for the purpose of preventing roller 210 from lifting away from cam 160 during dynamic operation. An extension valve spring 230*a* with loop ends is attached to shaft 220 and connects exhaust valve lever 90*a* to frame 85, as seen in FIG. 15, for the purpose of preventing roller 210 from lifting away from cam 200 during dynamic operation.

Referring to FIG. 13, a flywheel 240 is attached to cam drive axle 110*b* for the purpose of providing the energy required during isentropic compression, as seen in FIG. 13. The flywheel 240 also helps recoup energy from isentropic expansion and storing some net energy generated by the engine.

Figure 19:
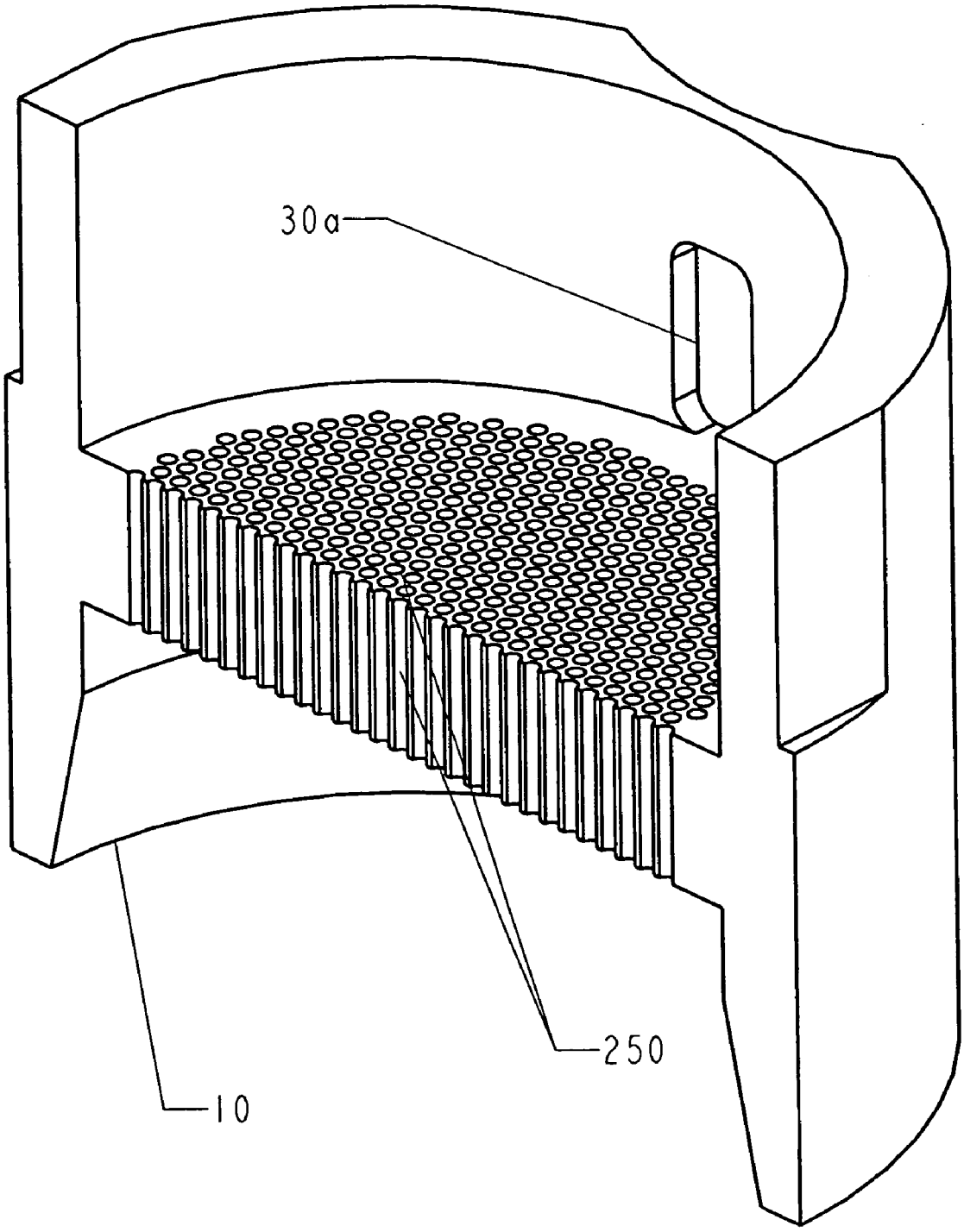
FIG. 19 is an enlarged perspective, sectional view of the heat exchanger component of the first embodiment of the apparatus.

The preferred embodiment for heat exchanger 10 is shown in FIG. 19. The exchanger 10 is a round piece of copper rod with a plurality of holes drilled along the axial direction there through, forming a plurality of passageways 250. Passageways 250 allow the working fluid to pass through the heat exchanger 10 between compression chamber 50 and transfer chamber 50*a*. Passageways 250 form the heat transfer surface area used to transfer energy to the working fluid. The volume taken up by passageways 250 is the heat exchanger volume, dead space or dead volume. This volume or space is unusable in the working of the engine in that the working fluid contained therein cannot be completely exhausted out of the engine. Excess dead space is believed to have deleterious effects on the operation of the engine by causing the temperature $T_A$ to be increased due to the mixing of intake working fluid with the dead space working fluid.

Referring to FIGS. 17 and 18, the various eccentric specialized cam profiles used in the invention are calculated from the timing desired as illustrated in FIG. 3. Thus, the timing of the pistons is first defined, as well as the geometrical relation between the pistons and the cam center. The variables defining the profile of the cams are given and it is a matter of calculating the points on the spline curve to generate the cam geometry.

The pistons of the present invention are graphite and are mated with glass cylinders to achieve very low friction and superb sealing characteristics. The matched pairs are available from Airpot Corporation, www.airpot.com.

The foregoing describes the construction of the engine generally in accordance with the present invention.

Details of Operation

FIGS. 14 and 15 illustrate that the actuation of the pistons 40, 40*a* is achieved through the cam drive assembly 150. As the cam assembly 150 turns clockwise, the cams drive the engine to perform the desired piston timing. External thermal energy is input into the engine via the cylindrical outside surface of heat exchanger 10 by any suitable of means. For the purpose of quantifying the overall energy input and efficiency, a standard circular electric resistance band heater can be used to power the engine.

To start the engine running, the heat exchanger 10 is heated to the desired high temperature and then a swift turning of the power shaft 110*b* by any of several appropriate means will impart sufficient energy to compress the intake air and carry through one isothermal process, generating power. After the isothermal process has finished, isentropic expansion occurs whereby the engine recoups more energy, the flywheel has gained sufficient energy and speed such that subsequent cycles occur automatically and the engine runs in steady operation.

Figure 21:
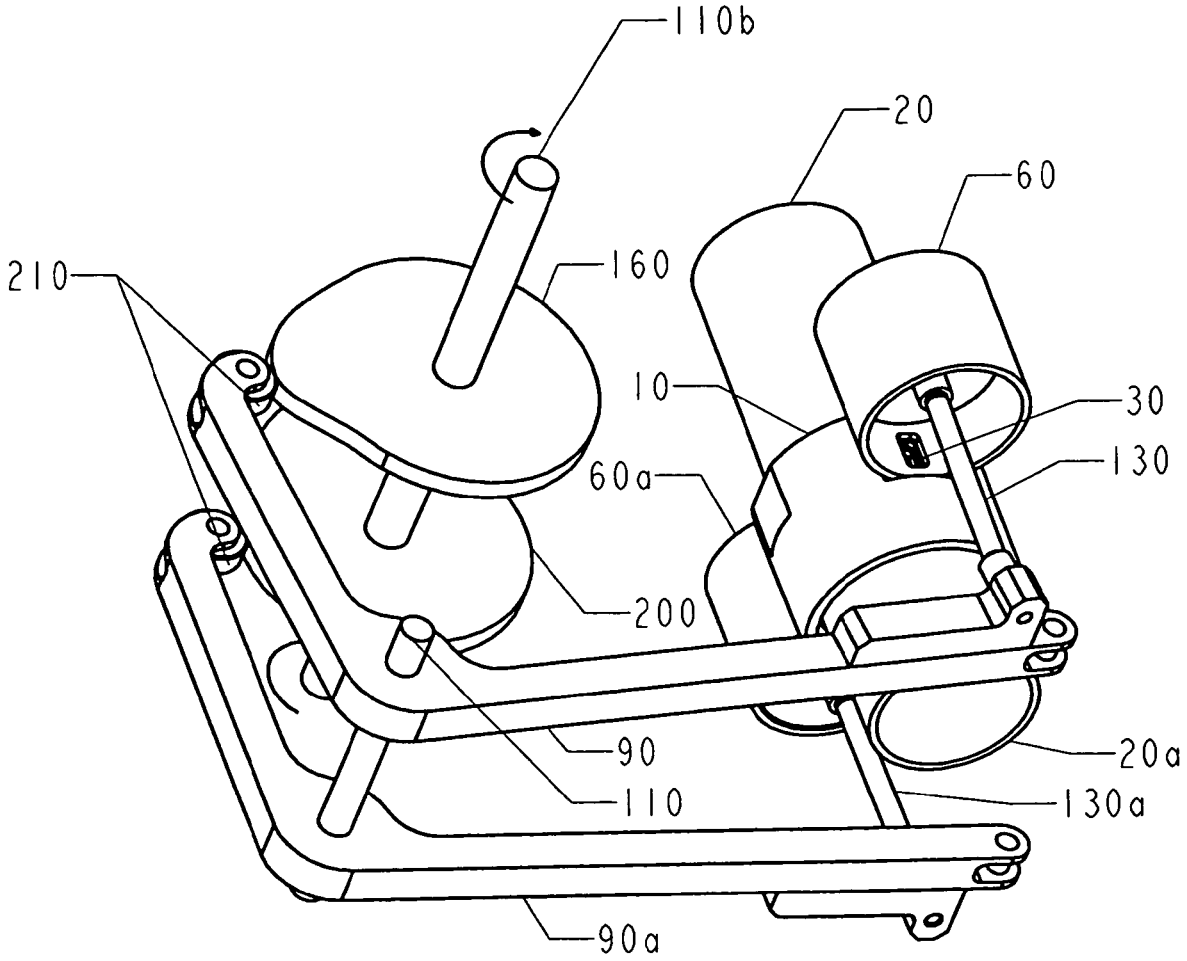
FIG. 21 is another perspective view from below of the embodiment of the apparatus seen in FIG. 13, showing valve piston actuation.

FIG. 20 is a front view detailing the cam drive of compression piston 40 and transfer piston 40*a*. Note that cams 170 and 180 cause the compression piston 40 to complete two full cycles for every revolution of cam axle 110*b*. Referring to FIG. 21, the function of the valve pistons is illustrated. The intake piston 70 is shown in the open position allowing the free flow of air through intake port 30 into compression chamber 50.

Having disclosed and described the fundamentals of a preferred embodiment of the invention, possible alternative embodiments are now presented.

Figure 22:
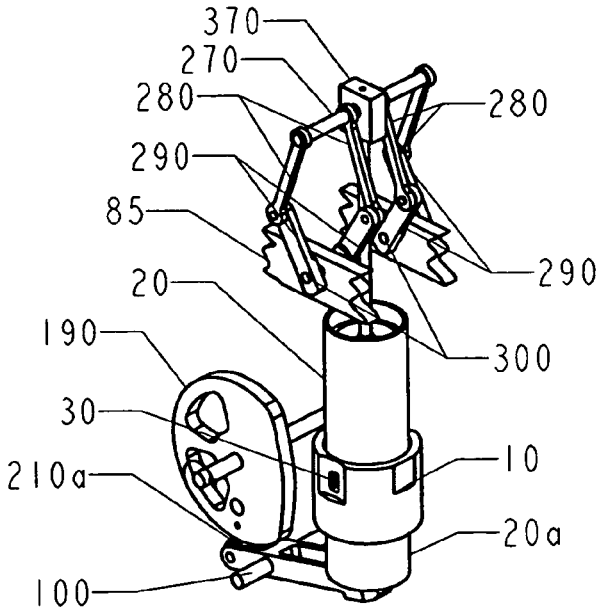
FIG. 22 is a side and top perspective view of a second embodiment of the apparatus according to the present invention, depicting among other things the compression piston drive geometry.

One alternative embodiment provides for a crankarm compression piston drive, whereby a compression push rod is mounted for reciprocating linear translation in relation to the frame 85, and is operatively connected to the compression piston 40. This alternative embodiment for driving the compression piston is illustrated in FIGS. 22 (isometric view) and 23 (front view). In this alternative embodiment, the mounting means includes a transverse shaft 270, at least two pairs of pivotal connection arms 280 pivotally connected to the transverse shaft, and at least two pairs of crank arms 290. Each of the crank arms is pivotally connected to a corresponding connection arm, and each of the connection arms is pivotally connected to the frame 85. The configuration provides that the push rod is connected to the transverse shaft 270, and at least two of the crank arms 290 are drivable in opposite directions by operative connection with, and rotation of one of the cams, to induce reciprocal translation of the push rod along its axis.

Figure 23:
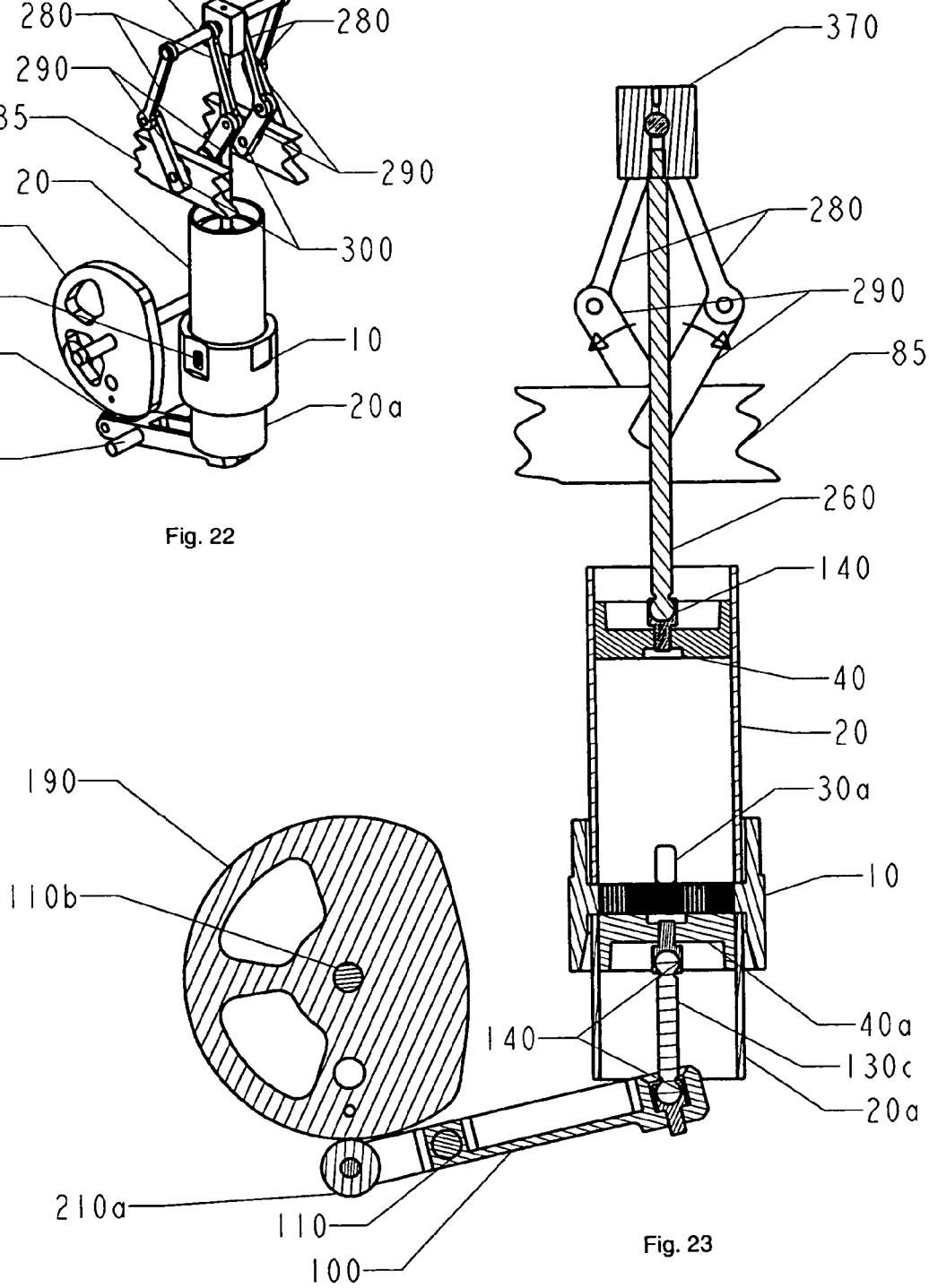
FIG. 23 is an enlarged side sectional view of the second embodiment of the apparatus seen in FIG. 22, also illustrating compression piston drive assembly.

Reference is made to FIG. 23 providing specific further details. A compression push rod 260 connects the compression piston 40 to the top transverse shaft 270 by means of the bushing block 370 through which the transverse shaft is rotatably disposed. Transverse shaft 270 is connected to a plurality, preferably four, connection arms 280. Each connection arm is connected to a crankarm 290. Crankarms 290 are attached to frame 85 via crank arm shafts 300 (FIG. 22). In this embodiment, the transfer cam 190 is connected through chains and sprockets, belts and pulleys, or gears as appropriate (not shown, any suitable known transmission means) to crankarms 290. The connection is designed such that a full revolution of the transfer cam 190 correlates to two full cycles of compression piston 40.

Crank arms 290 are set in counter rotating motion so as to cause the compression piston 40 to move downward and compress the working fluid. The two crank arms 290 nearest the compression piston axis turn in one direction, while the two outside crank arms rotate in the opposite direction, as indicated by the directional arrows of FIG. 23. This ensures that the forces acting on the push rod 260, and hence the compression piston 40, are confined in the vertical direction only. This prevents non-axial side forces on the walls of the compression cylinder 20, reducing friction and enhancing the lifetimes of the piston 40 and cylinder 20. The power takeoff for the engine is through the drive axle 110 *b*.

Figure 24:
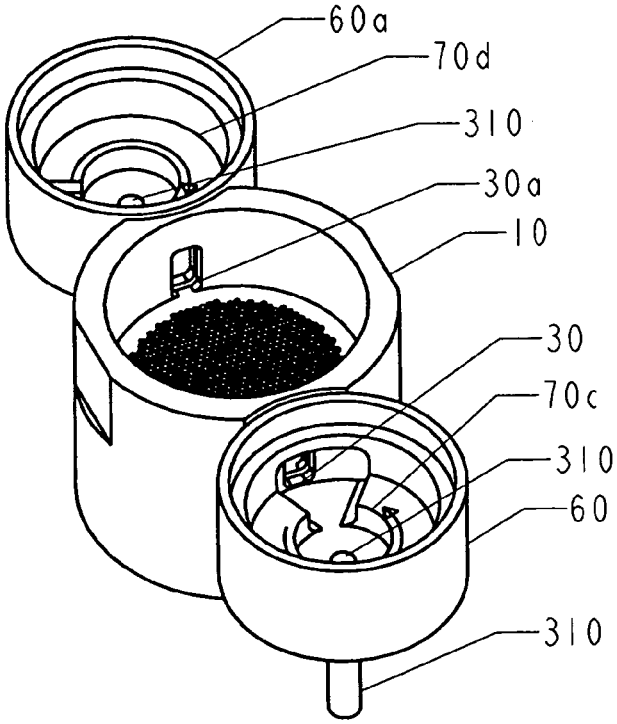
FIG. 24 is an enlarged perspective view, from above, of a portion of the second embodiment of the apparatus, showing one embodiment of the valve assembly useable in accordance with the present invention.
Figure 25:
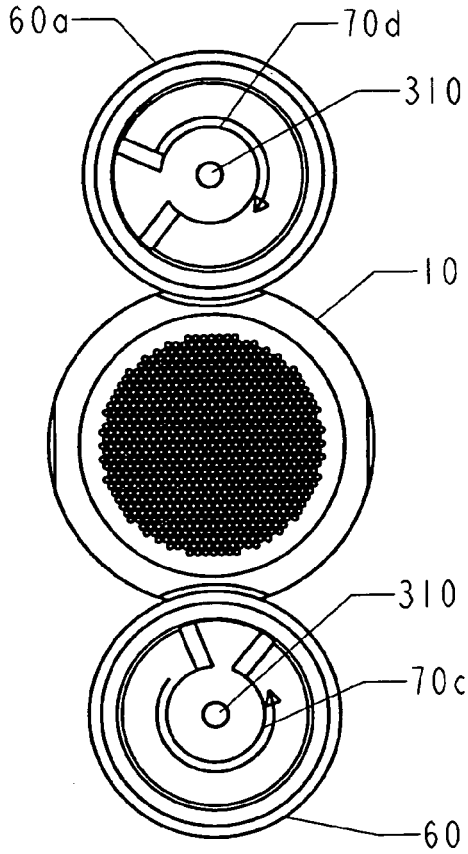
FIG. 25 is a plan top view of the valve assembly seen in FIG. 24, illustrating valve rotation.
Figure 26:
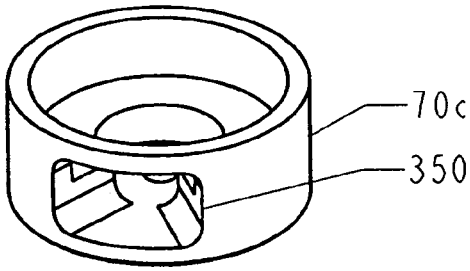
FIG. 26 is a perspective view of a valve component of the apparatus components seen in FIG. 24, providing additional valve detail.

An alternative embodiment to the preferred design of the intake and exhaust valves is illustrated in FIGS. 24-26. This alternative embodiment provides a rotating valve configuration.

FIG. 24 shows an intake valve piston 70*c* fitted inside and substantially coaxial with intake valve cylinder 60, and an exhaust valve piston 70*d* fitted inside and substantially coaxial with exhaust valve cylinder 60*a*. The valve pistons 70*c*, 70*d* are generally concave or hollow, such that their interiors are open to the ambient environment. Each valve piston has an elongated slot 350 in its side, as shown in FIG. 26 corresponding with a valve port 30 or 30*a*. The intake valve port 30 is defined at least in part by an intake aperture in the intake valve cylinder 60; more specifically, the intake aperture in the valve cylinder is aligned with a corresponding aperture in the compression cylinder 20. Similarly, the exhaust valve port 30*a* is defined at least in part by an exhaust aperture in the exhaust valve cylinder 60*a*, with such exhaust aperture aligned with a corresponding aperture in the compression cylinder 40.

In the valve embodiment of FIGS. 24 and 25, the intake valve cylinder 60 and the exhaust valve cylinder 60*a* are disposed exterior to, but perhaps immediately adjacent to and on opposite sides of, the compression cylinder 40. Working fluid thus may flow through the valve pistons 70*c*, 70*d* via the apertures or slots 350—the intake valve piston 70*c* having an intake slot or aperture alignable with the intake valve port 30, and the exhaust valve piston 70*d* having an exhaust slot or aperture alignable with the exhaust valve port 30*a*. Each valve piston 70*c*, 70*d* has an associated valve drive axle 310 operatively connected to its bottom, which in turn has a suitable operative connection to a valve drive means.

In this embodiment, valve rotation is accomplished through the appropriate arrangement of gears, pulleys, belts, sprockets and chains (not shown; any suitable and appropriate transmission means) operatively connected to a valve drive axle 310, such that for each single revolution of drive axle 110*b*, the valve pistons 70*c*,70*d* each rotate through one revolution. An intake valve axle 310 is in operative connection with the intake valve piston 70*c* and the cam drive axle 110*b* (FIG. 13), such that rotation of the drive axle 110*b* imparts rotary motion to the intake valve axle 310 to open and close the import valve 70*c* repeatedly and periodically. Likewise, the exhaust valve axle 310 is in operative connection with the exhaust valve piston 70*d* and the drive axle, so that when the drive axle rotates, it imparts rotary motion to the exhaust valve axle to open and close the exhaust valve in a manner complementary to the operation of the import valve 70*c*. Thus, the intake valve piston 70*c* is rotatable within the intake valve cylinder 60 between an open position when the intake slot 350 is aligned with the intake valve port 30, and a closed position when the intake slot is out of alignment with the intake valve port. The exhaust valve piston 70*d* is rotatable within the exhaust valve cylinder 60*a* between an open position where the exhaust slot 350 is aligned with the exhaust valve port 30*a*, and a closed position when the exhaust slot is out of alignment with the exhaust valve port. Of course the opening and closing of the intake and exhaust valves can be timed relative to one another by the selected angular locations of the intake and exhaust slots 350 in relation to the rotational axes (axles 310) of the valve pistons.

FIG. 25 shows, with directional arrows, the rotational directions of the valve pistons 70*c*, 70*d*. In FIG. 25 the intake valve 70*c* is open. The rotational direction for each valve piston can be adjusted as required by manipulating the chosen drive means. The dimensions of the valve slot 350 (shown in FIG. 26) for each piston 70*c* or 70*d* may be customized to meet the requirements of valve open time.

Figure 27:
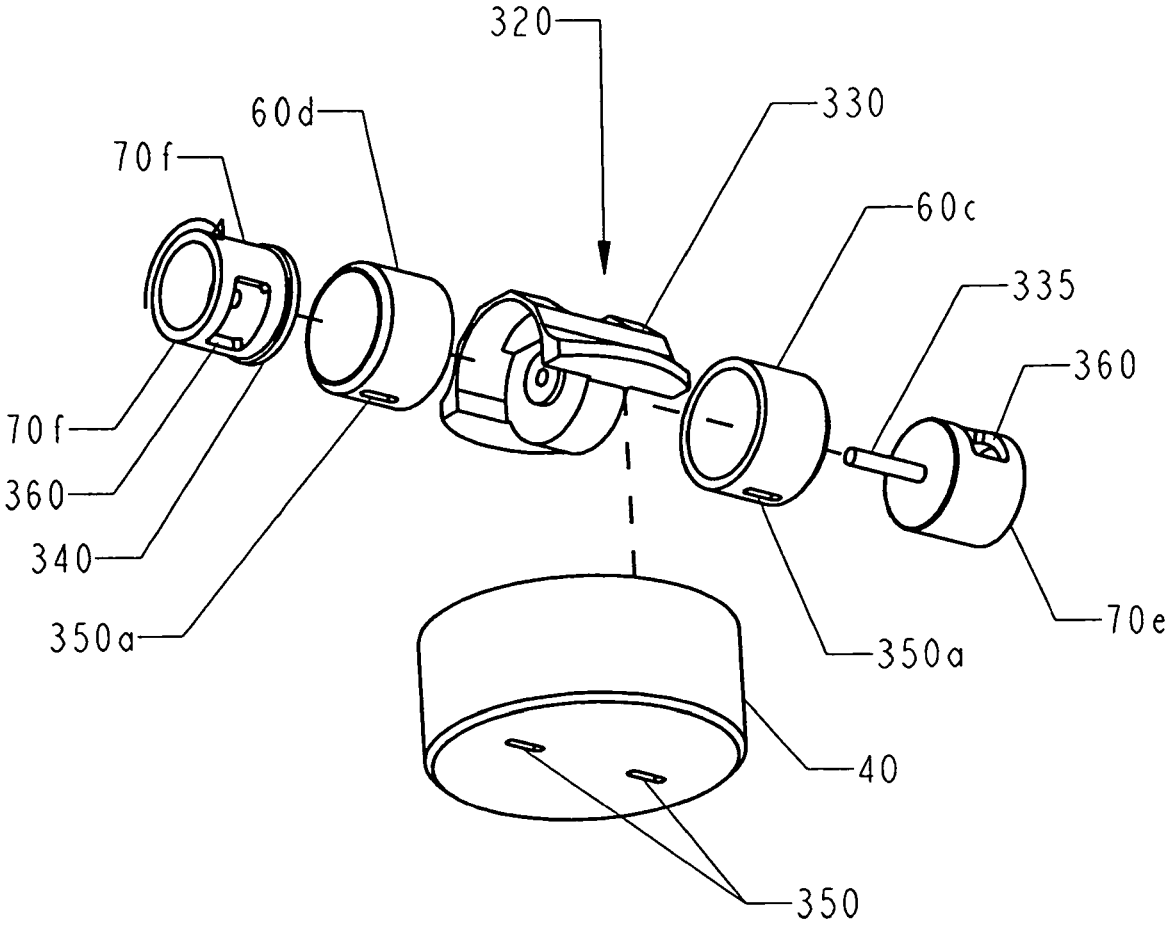
FIG. 27 is a perspective exploded view of the valves and piston components and assembly for a third embodiment of the apparatus according to the present invention.
Figure 28:
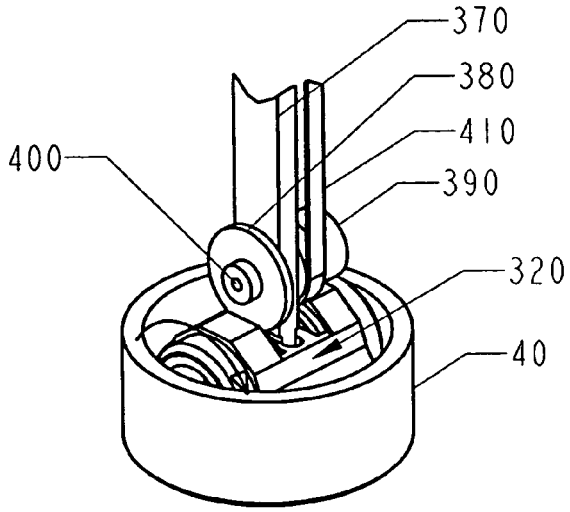
FIG. 28 is a top perspective view of a portion of the valves in piston portion of the third embodiment of the apparatus.
Figure 29:
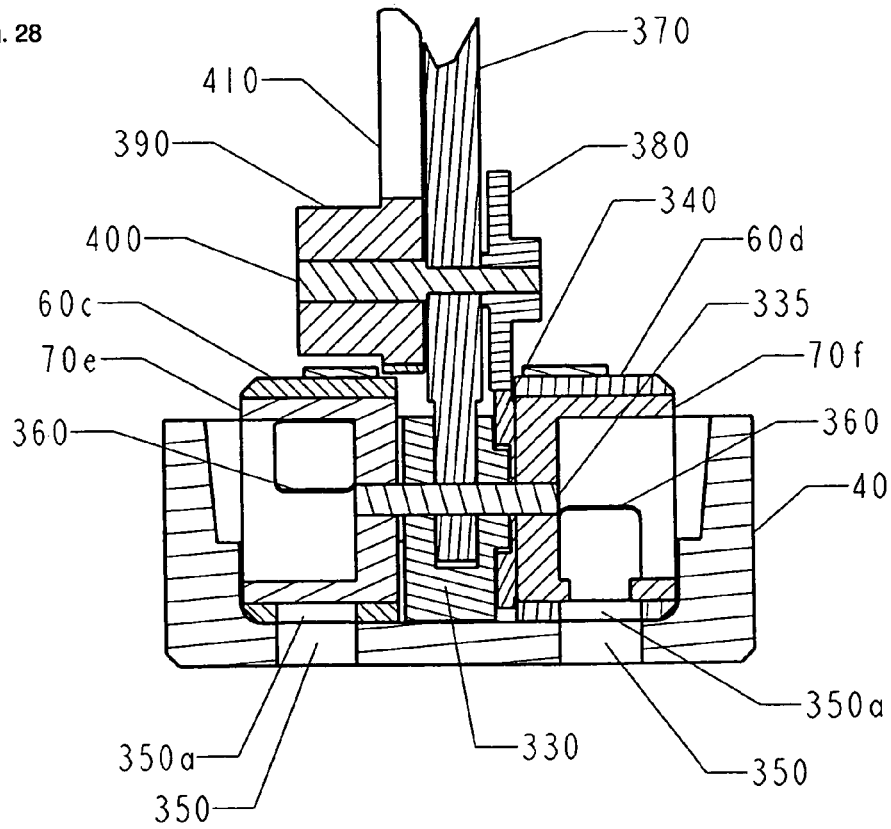
FIG. 29 is an enlarged side sectional view of the valve and piston assembly seen in FIG. 28.

Yet another alternative embodiment to the preferred embodiment is illustrated in FIGS. 27-29, showing an embodiment whereby the intake and exhaust valves are in or on the compression piston 40. Referring to FIG. 27, a valve assembly 320 is comprised of a valve mount bracket 330 with an intake valve cylinder 60*c* and an exhaust valve cylinder 60*d* mounted thereto. An intake valve piston 70*e* fits inside intake valve cylinder 60*c* and is attached to a valve piston shaft 335. An exhaust valve piston 70*f* fits inside exhaust valve cylinder 60*d* and is attached to valve piston shaft 335. A valve driven gear 340 is attached to the exhaust valve piston 70*f*.

Valve assembly 320 attaches to compression piston 40. Compression piston 40 has two elongated holes or apertures 350 cut through it. Exhaust and intake valve cylinders 60*c* and 60*d* both have an elongated slot or aperture 350*a* in the side wall as seen in FIG. 27. These apertures match with respective apertures in compression piston 40 to form intake port 30 and exhaust port 30*b*, respectively.

Intake valve piston 70*e* and exhaust valve piston 70*f* each have slots 360 cut into their sides which, when overlapped with their respective valve ports, corresponds to the "valve open" condition. The size of each slot or aperture is tailored to the required open time of the respective valve.

In this embodiment, accordingly, the intake valve port is defined at least in part by an intake slot or aperture 350*a* in the intake valve cylinder 60*c*, such intake aperture aligned with a corresponding slot or aperture 350 in the compression piston 40, and the exhaust valve port is defined at least in part by the exhaust aperture 350*a* in the exhaust valve cylinder 60*d*, such exhaust aperture also being aligned with a corresponding slot or aperture 350 in the compression piston, so that working fluid may flow through the compression piston. The intake valve cylinder 60*c* and the exhaust valve cylinder 60*d* are disposed on the compression piston 40, as best illustrated by FIGS. 28 and 29.

Referring to FIGS. 28 and 29, a compression push rod 370 is mounted to the valve assembly 320 with a valve piston shaft. A valve drive gear 380 and a valve pulley 390 are attached to compression rod 370 by a through-mounted valve drive shaft 400. A valve drive belt 410 drives the valve pulley 390. FIG. 29 shows a cross sectional view of the valves-on-piston design as assembled. It should be noted that this embodiment does not preclude the use of other valve schemes placed in the compression piston 40, such as conventional automotive style poppet valves.

FIG. 28 illustrates that valve rotation is accomplished through the appropriate arrangement of gears, pulleys, belts, sprockets and chains such that for a single revolution of drive axle 110*b*, valve drive belt 410 is driven such that the valve pistons each rotate through one rotation. With the appropriately located and sized valve apertures 360, the valve ports 30 and 30*a* are each opened one time per cycle for the appropriate length of time to achieve the required exhaust and intake processes. Shown here is the valve drive belt 410 driving a valve pulley, and hence the valve drive gear 380 by their connection through valve drive shaft 400. Valve drive gear 380 drives valve driven gear 340, and hence exhaust valve piston 70*f* is driven. Intake valve piston 70*e* is rotated by the connection to piston 70*f* via valve piston shaft 335.

Figure 30:
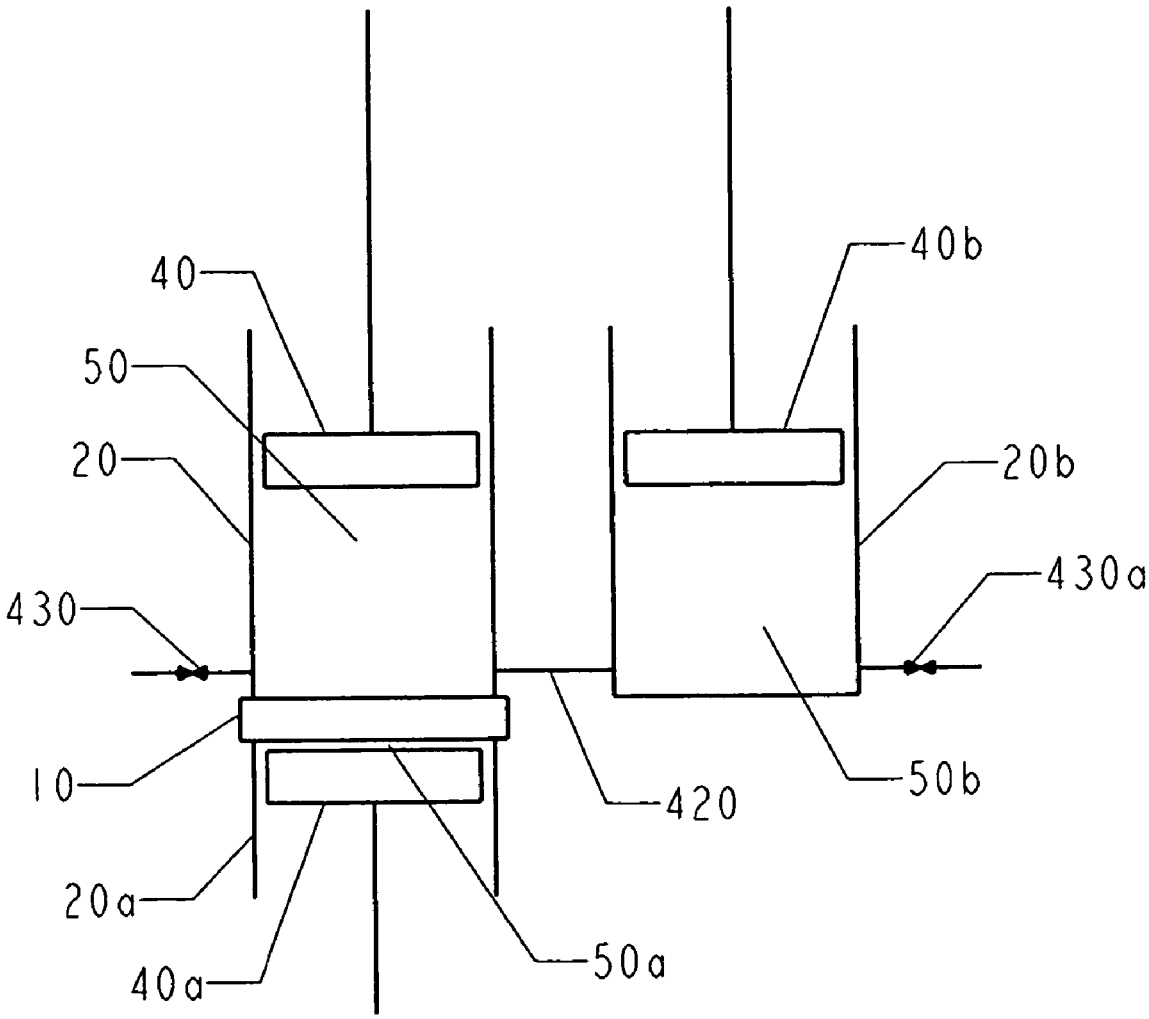
FIG. 30 is a diagrammatic side view of a yet another embodiment of the apparatus according to the present invention, illustrating a two compression piston engine.

Another alternative embodiment of the apparatus provides for two or more co-operating compression pistons in the engine, there being at least one supplemental compression piston slidable for reciprocating motion within a supplemental compression cylinder; and a passageway for fluid communication between the main compression cylinder 20 and the supplemental compression cylinder. At higher temperatures, the engine begins to require large compression ratios $C_r$, in some cases making the required cylinder lengths prohibitively long from manufacturing ease and cost standpoints. Referring to FIG. 30, an alternative embodiment wherein two compression cylinders and pistons are used to achieve high compression ratios is illustrated.

The supplemental compression piston 40*b* and supplemental cylinder 20*b* are provided for the purpose of effectively doubling the length of the compression cylinder, allowing for larger compression ratios and thus higher efficiencies and power outputs. Compression piston 40*b* and supplemental cylinder 20*b* form a supplemental compression chamber 50*a*. A passageway 420 is provided for communication between the compression cylinder 20 and the supplemental cylinder 20*b*. An intake and exhaust valve 430 is provided for on cylinder 20. A supplemental valve 430 is provided for on cylinder 20*b* for the purpose of intake and exhaust. The provision for supplemental valves on the supplemental cylinder 20*b* serves to reduce pumping losses. Separate valves for intake and exhaust purposes may be provided to eliminate working fluid cross-communication during exhaust and intake. Supplemental valve 430*a* can be eliminated such that the engine has only one valve 430 on cylinder 20 for intake and exhaust. Elimination of valve 430*a* results in an increase in pumping losses in the engine as a double volume of working fluid is forced through valve 430 during intake and exhaust each cycle.

In this cooperative supplementary-piston embodiment, compression pistons 40 and 40*b* operate in tandem with the same position and timing. Valves 430 and 430*a* operate in tandem with the same timing and open periods. Referring to FIG. 30, the timing of pistons 40 and 40*a* are unchanged. Valve 430 and 430*a* are open when the timing diagram shows either valve 70 or 70*a* open.

Piston drive is accomplished by any of the various well known methods or one of the embodiments herein already described. Power is drawn from the engine in the same way the other engine embodiments or through any other appropriate means depending on piston drive selected.

It will be apparent from the foregoing that an alternative embodiment comprising a multiple piston engine apparatus may be provided in accordance with the teachings of the invention. In normal engineering practice, it is customary to use the machinery and components as much as possible. In the case of the preferred embodiment and the previous alternative embodiment, the transfer piston 40*a* and heat exchanger 10 use a percentage of total operation time equal to the cycle time fraction. That is, when the engine is not performing isothermal expansion, those components are not being utilized.

Figure 31:
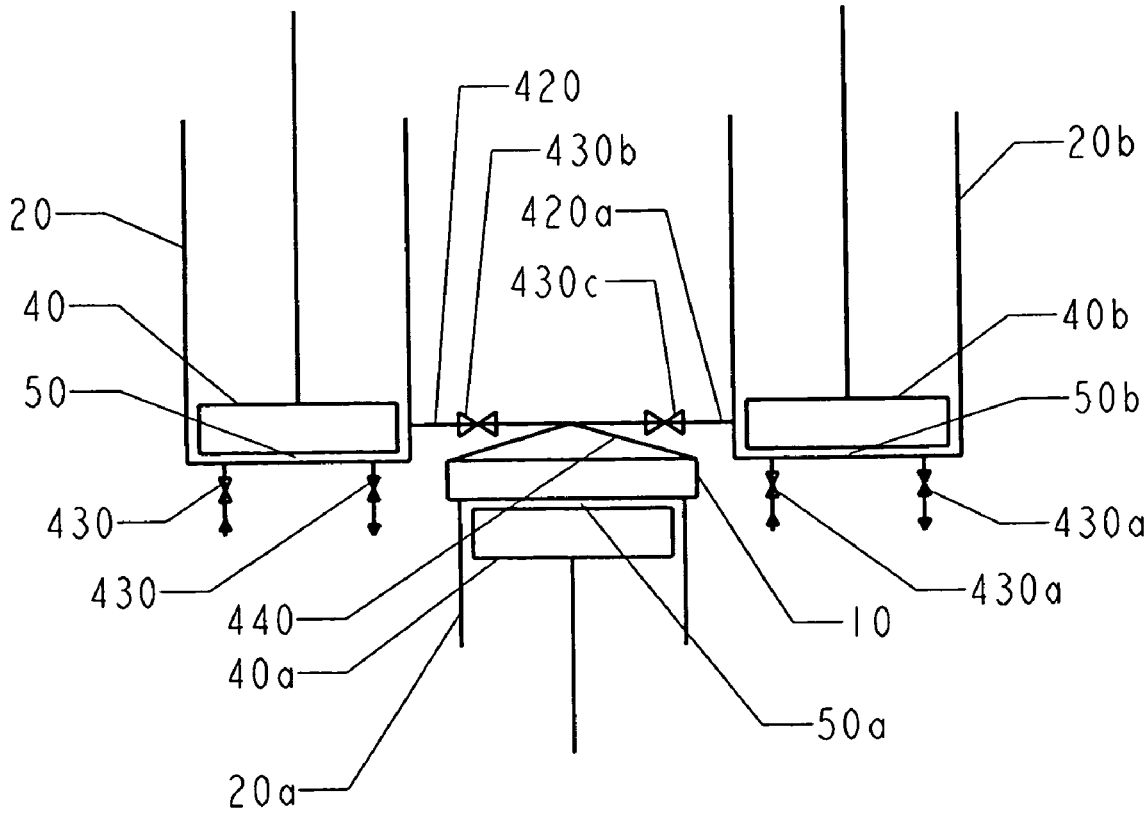
FIG. 31 is a diagrammatic side view of still another alternative embodiment of the apparatus according to the present invention, illustrating a two (multiple) piston engine.

Referring to FIG. 31, an alternative embodiment is disclosed which utilizes two separate compression pistons, operating in distinct phases, such that the heat exchanger and transfer piston are being utilized full time. The engine is configured such that compression pistons 40 and 40*b*, and compression cylinders 20 and 20*b*, are connected to heat exchanger 10 through passageways 420 and 420*a* respectively. Compression piston 40*b* and supplemental cylinder 20*b* form a supplemental compression chamber 50*a*. A control valve 430*b* is placed in passageway 420 and a control valve 430*c* is placed in passageway 420*a* for the purpose of controlling flow from the respective cylinders, through a manifold 440 and through heat exchanger 10. Transfer piston 40*a* pulls air into transfer chamber 50*a* by moving away from heat exchanger 10. Intake and exhaust valves 430 and 430*a* are used for intake and exhaust control of working fluid.

The timing of the pistons is altered such that the cycle time fraction is 50%. That is, isothermal expansion comprises half the cycle while expansion, intake, exhaust and compression comprise the rest. Pistons 40 and 40*b* are actuated 180° out of phase such that piston 40 performs isothermal expansion with valve 430 open, allowing the free flow of working fluid through heat exchanger 10 and into transfer chamber 50*a*. At the same time, piston 40*b* is performing isentropic expansion, exhaust, intake and isentropic compression with valve 430*a* closed, preventing flow between the second cylinder 20*b* and transfer chamber 50*a*. After half a cycle the rolls are reversed, and the second piston 40*b* performs isothermal expansion while piston 40 performs expansion, exhaust, intake and compression. Advantageously, in this operation scheme transfer piston 40*a* and heat exchanger 10 are used substantially full time.

In this multiple-piston embodiment there thus is provided, effectively, a supplemental compression chamber 50*b* into which a second unit mass of working fluid may be drawn. Such supplemental compression chamber 50*b* is defined at least in part by the second compression cylinder 20*b*, with the second compression piston 40*b* slidable for reciprocating motion within the second compression cylinder to draw the second unit mass into the second compression chamber, and to isentropically compress the second unit mass to a higher temperature and pressure. The passage means 420 and 420*a* provide for fluid communication between the heat exchanger 10 and the first compression chamber, and between said heat exchanger and the second compression chamber 20*b*, respectively. The valve means 430*b* and 430*c* are for controlling flow of working fluid through said passage means 420, 420*a*.

The heat exchanger 10 is disposed operatively between the second compression chamber and the transfer chamber, so that the heat exchanger imparts thermal energy to the working fluid while at least a portion of the second unit mass of fluid is moving past the heat exchanger (under the urging of either compression piston 40 or 40*b*), so that at least a portion of the second unit mass isothermally expands to a first subsequent volume. As with the single-cylinder embodiment, the transfer piston 40*a* draws away from the heat exchanger to allow the unit mass of fluid to be drawn into transfer chamber 50*a* while either compression piston 40 or 40*b* pushes the working fluid (air). At transfer piston 40*a* bottom dead center, the pistons' roles reverse; transfer piston 40*a* pushes air out of transfer chamber 50*a* while either compression piston 40 or 40*b* draws away from the heat exchanger 10, allowing the unit mass to flow past heat exchanger 10 and into either compression chamber 50 or 50*b*. Both compression pistons 40 and 40*b* are responsive at different times to isentropic expansion of the unit mass to a second subsequent volume within the compression chamber. Very most preferably, of course, the compression pistons of a multi-piston embodiment reciprocate out-of-phase in relation to each other.

In the multi-piston embodiment of FIG. 31, intake valves are in communication with corresponding ones of the compression chambers, and are movable between an open condition for allowing working fluid to be drawn into the engine and a closed condition to prevent working fluid from exhausting from the engine. In a similar manner, exhaust valves are in communication with corresponding ones of the compression chambers, and are movable between an open condition for allowing working fluid to exit the engine and a closed condition to prevent working fluid from being drawn into the engine.

The compression piston 40 is movable in the first compression cylinder 20 to push at least a portion of a first unit mass of working from the first compression chamber, past the heat exchanger 10, and toward the transfer chamber defined in part by the transfer cylinder 20*a*; and, the second compression piston 40*b* is movable in the second compression cylinder 20*b* to push at least a portion of a second unit mass of working fluid from the second compression chamber, past the heat exchanger 10, and toward the transfer chamber. Importantly, when the compression piston 40 is isothermally expanding the first unit mass of fluid in tandem with transfer piston 40*a*, the second compression piston 40*b* simultaneously is moving. During the isothermal expansion of the first unit mass of fluid, the second compression piston 40*b* may be isentropically expanding the second unit mass of working fluid, or exhausting the second unit mass of working fluid, or intaking a second unit mass of working fluid, or isentropically compressing the second unit mass of working fluid, thus optimizing the utilization of the heat exchanger 10 and transfer piston 40*a*.

Cylinders 20 and 20*b* can each be comprised of multiple cylinders such that very high compression ratios can be achieved. That is, multiple pistons working in tandem can be placed 180° out of phase with an equal number of multiple cylinders working in tandem on the other side to achieve high compression ratios yet still operate substantially the same as the current embodiment.

The engine of the present invention provides a method and apparatus for converting thermal energy to mechanical energy that can use a wide range of fuels and operate with a high efficiency in a package that is reasonably small and inexpensive to build. Because there is no explosive combustion of fuel products, the engine operates quietly.

The simplified design and open cycle operation allows for a design with reduced sealing requirements and eliminates the regenerator and cold heat exchanger required in Stirling and Ericsson engines. This significantly reduces dead space as compared to Stirling and Ericsson engines.

Further the engine according to the invention eliminates the cold isothermal process seen in Stirling and Ericsson cycles and thus requires no cooling. Because there is only one heat exchange process, thermal management is simplified and the problem of preventing heat transfer between hot and cold sources inherent in Stirling and Ericsson engines has been eliminated. Further, exhausting the working fluid to the ambient temperature allows for a lower engine effective cold temperature than is reasonably achieved in Stirling and Ericsson engines.

While the description herein above contains many specifics, these should not be construed as limitations on the scope of the invention, but rather as an exemplification of one preferred embodiment thereof. Many other variations are possible. For example, while it is de-emphasized herein, the present invention when run in reverse can be utilized as a refrigeration or heat pump device.

The size and scale of the engine is not limited by any design specifics herein disclosed. The engine in the present invention can be made with components small enough to provide output power on the order of 1 W, and can be made large enough to generate power for even the largest applications. The engine can be scaled such that many engines or many pistons are combined into one to provide power of virtually any magnitude desired.

Plainly, the engine will be utilized as a component in a system. That is, the engine would be a component in a system comprising a fuel storage, delivery and combustion apparatus providing the motive thermal energy thereto. The thermal delivery apparatus can also be a solar concentrating system providing concentrated solar energy to the engine for motive energy. The thermal energy source is not limited to various fuels and solar radiation, but can also be supplied by geothermal, nuclear, industrial waste heat or virtually any other source of heat.

The mechanical power output can be connected to another energy conversion device such as an electrical generator to convert the mechanical power derived from the engine into electrical power. The mechanical shaft power can be used to drive a pump, fan, blower, vehicle, boat or any other device requiring shaft power.

Moreover, the warm exhaust gasses of the engine are suitable for applications requiring heating. Specifically, the exhaust gasses can be used to heat water, air, food, residential and occupational spaces wherein the required temperature is less than say 200° C., which is the expected maximum exhaust temperature of the engine wherein the expansion ratio $E_r$ is not excessive. Remember that the exhaust temperature is primarily a function of $E_r$.

An alternative embodiment of the thermodynamic cycle is to expand to point D (FIG. 3) such that the volume at D equals the volume at A. This alternative embodiment is thermodynamically less desirable because there is a certain amount of recoverable work that is lost in doing so. However, the benefit of reduced complexity and size achieved may offset the potential work lost.

Yet an alternative embodiment to the preferred thermodynamic cycle is to not exhaust to and intake from ambient, but to use a large reservoir with an alternative working fluid such as hydrogen, helium or argon whereby exhaust heat is removed from the working fluid through the walls of the reservoir. The advantage of using alternative working fluids is increased heat transfer. The use of a reservoir allows for a high pressure system whereby average pressure of the cycle is increased and power output of the engine is increased.

There are a great many alternatives for piston and cylinder designs. Standard automotive style metallic pistons with annular sealing rings can be used. Ceramic pistons and cylinders can be used. Pistons and cylinders that represent low sliding friction, good sealing and withstand high temperatures are candidates for use.

Compression cylinder 20 and transfer cylinder 20*a* are shown having equal diameters. An alternative embodiment of the engine is to have either cylinder larger than the other. The potential benefit of this is to reduce the stroke length of the cylinder that is made larger in diameter.

The pistons and cylinders used in the engine for compression and transfer of working fluid can be replaced by bellows, said bellows forming chambers 50, 50*a* and 50*b* with substantially one part. This reduces the complexity and number of parts in the engine and improves the sealing of the working chambers. Thus, reducing or expanding the volume of a given chamber may be accomplished, rather than by moving a piston in a cylinder, by shrinking or collapsing a bellows.

While copper is the preferred material for the heat exchanger 10 due to its superior heat conduction properties, other metals such as aluminum, steel, brass, etc. may be used to reduce cost. More exotic materials such as titanium, nickel alloys, beryllium, tungsten, etc. may be used for their higher melting points. Non-metallic materials such as graphite, carbon and ceramics may also be considered provided they have sufficiently high heat conduction properties and melting points.

The design variations of the heat exchanger 10 are nearly endless, and the exchanger configuration in the drawing figures is by way of example rather than limitation. Any design which has a large surface area, allows the working media to flow through with minimal flow restriction, good material thermal conduction properties, good heat convection properties, and can be produced at a reasonable cost is a potential candidate for use as a heat exchanger. For example, a honeycomb design can be used. A long sheet of thin metal of desired width can be wound in a spiral to achieve large surface area. Concentric rings of equal width can also be used to achieve large surface area. Metallic meshes and foams are well known for providing very large surface areas in a relatively small volume.

Additionally, the hole geometry of the heat exchanger can be changed such that the surface convective properties are improved by inducing turbulent flow. For example, the roughness of the drilled holes can be increased, bumps on the surfaces of the holes, spiral grooves inside the holes, etc. can be made to induce turbulent flow and improve the convective heat transfer. A suitable thermal surface treatment or coating at the top of the heat exchanger to minimize heat transfer from that surface can reduce energy lost during exhaust and intake.

Piston drive can be achieved in any number of well known methods. The standard automotive style drive scheme can be used, as well as more exotic drive schemes used in the Stirling engines such as rhombic drives, scotch yoke designs, wobble yoke designs, etc.

Piston drive actuation can be achieved by hydraulic actuation, whereby the valves, compression and transfer pistons are actuated by hydraulic means such as hydraulic cylinders. The piston drive can also be achieved electromechanically, similar to what is currently done in free piston Stirling engines. If an appropriate bi-directional electromechanical device is chosen to drive either the piston push rod or the piston directly, then the electromechanical device performs alternatively as an actuator and as an electrical generator depending on the stage of the cycle the engine is in. The electromechanical device can then be connected electrically to a battery, capacitor or other appropriate electrical energy storage device such that the need for a flywheel is eliminated. The power take off is then electrical. Alternatively, the energy can be stored in a flywheel connected electrically to the electromechanical devices by a rotational electric generator. Control of the pistons is achieved through the use of an appropriately programmed computer or electronic controller.

The exact timing of the compression and transfer pistons can be dynamically controlled by placing temperature and pressure sensors inside the working chambers and feeding the information into an electronic controller such as a programmable logic controller or computer. The computer uses the temperature and pressure information to dynamically control piston movement to achieve the desired performance. In this case the hydraulic, electromechanic and to a lesser extent the cam actuation methods can be used to achieve the desired result.

The thermodynamic cycle can be achieved with the same components being actuated in a slightly different manner. That is, the transfer piston 40*a* and transfer cylinder 20*a* can be made exactly the same as compression piston 40 and compression cylinder 20. Additional exhaust and intake valves can be placed on the transfer cylinder such that both cylinders can be used to draw in air and compress it adiabatically. After the adiabatic compression, isothermal expansion begins whereby transfer piston 40*a* stops before it reaches top dead center and reverses direction while compression piston 40 continues to bottom dead center, pulling working fluid through heat exchanger 10. When piston 40 reaches bottom dead center, they both reverse direction and force the working fluid again through heat exchanger 10. The working fluid is in this way shuttled through the heat exchanger as many times as necessary to reach the desired expansion ratio $E_r$, after which both pistons are used to perform adiabatic expansion, exhaust and intake to repeat the cycle again. The benefit of this embodiment is an effective doubling of the working fluid mass and therefore a doubling of output power provided by the engine.

If the engine of the preferred embodiment is designed for sufficiently high temperatures requiring very large compression ratios, the performance of the current invention can be enhanced by the use of pre-compression and/or post expansion devices, such as a turbo machine, a screw type compressor, or any other compressor whose function is to compress or expand a gas more or less adiabatically. The pre-compression device compresses the air adiabatically and pushes it through an appropriate passageway and valve into the compression chamber whereby further compression, then isothermal expansion and finally isentropic expansion is performed. The working fluid is thereafter pushed through another appropriate passageway and valve to an expansion device whereby the rest of the available expansion energy is recovered.

The present invention does not preclude the use of a single valve for use in both intake and exhaust. That is, a single valve can be designed with appropriate flow passages such that cross talk, or mixing of intake fluid with exhaust fluid is prevented or minimized. The obvious advantage to this is reduced complexity.

Additionally, the type or design of valve used is not limited to those shown in the present invention or its alternative embodiments. The variety of valve designs is nearly limitless and many of them are suitable for use in the engine. For example, standard automotive poppet style valves, rotating butterfly style valves, plug valves, ball valves and any other standard and appropriate valve can be used.

While the current invention does not include an automatic starting means or mechanism, there are many well known methods for doing so, such as the electric starter motors used in the current automotive engines, the use of springs, manual pull strings, manual cranks and others.

The inventive engine does not include the use of a filter to remove damaging particles or contaminants from the intake air. In environments where this is required, an air filter is placed at or before the intake port.

The current engine does not include the use of power and speed limiting or controlling devices. Speed and power limiting and controlling is achieved by controlling the thermal energy input or available as well as the shaft power demands at the output. As such, speed and power limiting devices are dependent on the system in which the engine is used. Nonetheless, the standard means of clutches, brakes, fuel flow control, etc can all be used.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method for converting thermal energy to mechanical energy, comprising the steps of:

providing a unit mass of working fluid;

isentropically compressing the unit mass of working fluid to a higher temperature and a higher pressure;

adding thermal energy from a source external to the working fluid to the unit mass while isothermally expanding the unit mass to a first subsequent volume;

moving at least one driving member by isentropically expanding the unit mass to a second subsequent volume; and exhausting at least a portion of the unit mass of working fluid to ambient environment.

2. A method according to claim 1 wherein the step of providing a unit mass of working fluid comprises drawing working fluid at an ambient temperature and an ambient pressure into a compression chamber.

3. A method according to claim 2 wherein providing a unit mass of working fluid further comprises drawing working fluid at an ambient temperature and an ambient pressure into a transfer chamber.

4. A method according to claim 2 wherein the step of drawing working fluid comprises withdrawing a compression piston within a compression cylinder.

5. A method according to claim 3 wherein the step of drawing working fluid comprises withdrawing a transfer piston within a transfer cylinder.

6. A method according to claim 2 wherein the step of drawing working fluid further comprises drawing ambient air through an open intake valve.

7. A method according to claim 1 wherein the step of isentropically compressing the unit mass comprises reducing the volume of a compression chamber.

8. A method according to claim 7 wherein the step of isentropically compressing the unit mass comprises moving a compression piston within a compression cylinder defining the compression chamber.

9. A method according to claim 1 wherein the step of isentropically compressing the unit mass comprises reducing the volume of a compression chamber while reducing the volume of a transfer chamber in fluid communication with the compression chamber.

10. A method according to claim 9 wherein reducing the volume of a compression chamber while reducing the volume of a transfer chamber comprises moving a compression piston in a compression cylinder while moving a transfer piston in a transfer cylinder.

11. A method according to claim 1 wherein the step of adding thermal energy to the unit mass while isothermally expanding the unit mass comprises moving the unit mass past a heat exchanger.

12. A method according to claim 11 wherein the step of adding thermal energy to the unit mass further comprises pushing with a compression piston at least a portion of the unit mass toward a transfer chamber in fluid communication with a compression chamber.

13. A method according to claim 12 further comprising expanding a volume defined by the compression and transfer chambers to allow isothermal heat addition.

14. A method according to claim 13 comprising the further step of moving at least one driving member by the isothermal expansion of the unit mass to a first subsequent volume.

15. A method according to claim 14 wherein moving at least one driving member comprises allowing the working fluid to push a transfer piston within the transfer chamber during an early period of the isothermal expansion.

16. A method according to claim 15 wherein moving at least one driving member comprises allowing the working fluid to push the compression piston within the compression chamber during a later period of the isothermal expansion.

17. A method according to claim 12 comprising the further step, after pushing with a compression piston at least a portion of the unit mass toward a transfer chamber, of pushing with a transfer piston at least a portion of the unit mass back toward the compression chamber.

18. A method for converting thermal energy to mechanical energy, comprising the steps of:

providing a unit mass of working fluid at an ambient temperature and an ambient pressure;

isentropically compressing the unit mass of working fluid to a higher temperature and a higher pressure;

heating the unit mass by moving the unit mass past a heat exchanger while isothermally expanding the unit mass to a first subsequent volume;

isentropically expanding the unit mass to a second subsequent volume, thereby moving a first driving member and a second driving member; and exhausting to ambient environment at least a portion the unit mass of working fluid.

19. A method according to claim 18 wherein the step of providing a unit mass of working fluid comprises drawing the working fluid into a compression chamber.

20. A method according to claim 19 wherein the step of providing a unit mass further comprises drawing the working fluid into a transfer chamber.

21. A method according to claim 19 wherein the step of drawing a working fluid comprises withdrawing a compression piston within a compression cylinder.

22. A method according to claim 21 wherein the step of drawing a working fluid comprises drawing ambient air through an open intake valve.

23. A method according to claim 19 wherein the step of isentropically compressing the unit mass comprises decreasing the combined volumes of the compression chamber and the transfer chamber.

24. A method according to claim 23 wherein the step of decreasing the combined volumes comprises moving a compression piston within a compression cylinder defining the compression chamber, the compression chamber being in fluid communication with the transfer chamber.

25. A method according to claim 19 wherein the step of heating the unit mass further comprises:

pushing with a compression piston at least a portion of the unit mass through the heat exchanger; and then pushing with a transfer piston at least a portion of the unit mass through the heat exchanger and toward the compression chamber.

26. A method according to claim 18 wherein isothermally expanding the unit mass comprises permitting the combined volume enclosed by a compression chamber and a transfer chamber to expand to allow isothermal heat addition to the unit mass.

27. A method according to claim 26 wherein permitting the combined volume to expand comprises maintaining the working fluid at a constant temperature.

28. A method according to claim 27 wherein moving a first driving member and a second driving member comprises allowing expanding working fluid to push a compression piston within a compression cylinder and to push a transfer piston within a transfer cylinder.

29. A method according to claim 25 wherein the step of exhausting at least a portion of the unit mass comprises pushing the working fluid with the compression piston and with the transfer piston.

30. An apparatus for converting thermal energy to mechanical energy, comprising:

means for drawing a unit mass of working fluid into a compression chamber at an ambient temperature and an ambient pressure, said means for drawing comprising:

a compression piston slidably movable within a compression cylinder; and a transfer piston slidably moveable within a transfer cylinder, said transfer cylinder in fluid communication with said compression cylinder;

means for isentropically compressing said unit mass of working fluid to a higher temperature and a higher pressure;

means, external to the working fluid, for heating said unit mass while isothermally expanding the unit mass to a first subsequent volume;

means for isentropically expanding said unit mass to a second subsequent volume; and means for exhausting at least a portion of said unit mass of working fluid.

31. An apparatus according to claim 30 wherein said means for drawing a working fluid further comprises an intake valve means, in fluid communication with said compression chamber, movable between an open condition for allowing ambient air into said compression chamber and a closed condition.

32. An apparatus according to claim 30 wherein said means for isentropically compressing the unit mass comprises a compression piston slidably movable within a compression cylinder.

33. An apparatus according to claim 32 wherein said means for isentropically compressing the unit mass further comprises a transfer piston slidably moveable within a transfer cylinder in fluid communication with said compression cylinder.

34. An apparatus according to claim 30 wherein said means for heating said unit mass comprises a heat exchanger.

35. An apparatus according to claim 33 wherein said means for heating said unit mass comprises a heat exchanger, and said compression piston is slidably movable in said compression cylinder to push at least a portion of said unit mass past said heat exchanger.

36. An apparatus according to claim 35 wherein said transfer piston is slidably movable in said transfer cylinder to push at least a portion of said unit mass past said heat exchanger.

37. An apparatus according to claim 36 wherein said compression chamber is substantially enclosed by said compression piston and said compression cylinder, said transfer chamber is substantially enclosed by said transfer piston and said transfer cylinder, and wherein further said means for isentropically expanding said unit mass to a second subsequent volume comprises said compression piston moving within said compression cylinder.

38. An apparatus according to claim 37 wherein said means for isentropically expanding said unit mass further comprises said transfer piston moving within said transfer cylinder.

39. An apparatus according to claim 30 wherein said means for exhausting at least a portion of said unit mass comprises an exhaust valve means, in fluid communication with a compression chamber, movable between an open condition for allowing working fluid to exhaust from said compression chamber and a closed condition.

40. An apparatus according to claim 33 wherein said heat exchanger is disposed between said compression cylinder and said transfer cylinder, and said compression piston pushes at least a portion of said unit mass from said compression chamber into said transfer chamber.

41. An apparatus according to claim 30 wherein said unit mass is exhausted to ambient air exterior to said compression chamber at a second higher temperature greater than ambient temperature.

42. An engine using a unit mass of working fluid to convert thermal energy into mechanical energy, comprising:

a compression chamber into which said unit mass of working fluid may be drawn, said compression chamber defined in part by a compression cylinder;

a compression piston slidable for reciprocating motion within said compression cylinder to draw said unit mass into said compression chamber and to isentropically compress said unit mass to a higher temperature and a higher pressure;

a transfer chamber into which at least a portion of said unit mass may be pushed, said transfer chamber defined at least in part by a transfer cylinder;

a transfer piston slidable for reciprocating motion within said transfer cylinder; and a heat exchanger disposed operatively between said compression chamber and said transfer chamber, wherein said heat exchanger imparts thermal energy to said working fluid while at least a portion of said unit mass is moving past said heat exchanger under the urging of said compression piston, whereby at least a portion of said unit mass isothermally expands to a first subsequent volume;

wherein said transfer piston and said compression piston are responsive to isentropic expansion of said unit mass to a second subsequent volume within said transfer chamber.

43. An engine according to claim 42 further including an intake valve in communication with said compression chamber, and movable between an open condition for allowing working fluid to be drawn into said engine and a closed condition to prevent working fluid from exhausting from said engine.

44. An engine according to claim 42 wherein said compression piston is movable in said compression cylinder to push at least a portion of said unit mass from said compression chamber, past said heat exchanger, and toward said transfer chamber.

45. An engine according to claim 42 further comprising an exhaust valve in communication with said compression chamber, and movable between an open condition for allowing working fluid to exhaust from said engine and a closed condition to prevent working fluid from being drawn into said engine.

46. An engine according to claim 42 wherein said compression cylinder and said transfer cylinder are attached to opposite sides of said heat exchanger, and further comprising:

a frame upon which said heat exchanger is mounted;

an intake valve lever mounted for pivotal motion on said frame, and operatively connected to said intake valve;

an exhaust valve lever mounted for pivotal motion on said frame, and operatively connected to said exhaust valve;

a transfer lever mounted for pivotal motion on said frame, and operatively connected to said transfer piston; and a cam drive assembly on said frame, said assembly comprising a plurality of rotatable cams engageable with corresponding ones of said levers to coordinate the timing of the movement of said pistons and said valves.

47. An engine according to claim 46 further comprising:

an intake valve port providing fluid communication between said compression chamber and the interior of an intake valve cylinder;

an exhaust valve port providing fluid communication between said compression chamber and the interior of an exhaust valve cylinder;

an intake valve piston within said intake valve cylinder, said intake valve piston slidable within said intake valve cylinder between an open position wherein said intake valve piston is removed from said intake valve port, and a closed position wherein said intake valve piston covers said intake valve port;

an exhaust valve piston within said exhaust valve cylinder, said exhaust valve piston slidable within said exhaust valve cylinder between an open position wherein said exhaust valve piston is removed from said exhaust valve port, and a closed position wherein said exhaust valve piston covers said exhaust valve port.

48. An engine according to claim 47 wherein said intake valve port is defined at least in part by an intake aperture in said intake valve cylinder, said intake aperture is aligned with an aperture in said compression cylinder, and said intake valve cylinder is disposed exterior to said compression cylinder.

49. An engine according to claim 47 wherein said exhaust valve port is defined at least in part by an exhaust aperture in said exhaust valve cylinder, said exhaust aperture is aligned with an aperture in said compression cylinder, and said exhaust valve cylinder is disposed exterior to said compression cylinder.

50. An engine according to claim 46 further comprising:

an intake valve port providing fluid communication between said compression chamber and the interior of an intake valve cylinder;

an exhaust valve port providing fluid communication between said compression chamber and the interior of an exhaust valve cylinder;

a hollow intake valve piston coaxial with said intake valve cylinder and having an intake aperture therein, said intake valve piston rotatable within said intake valve cylinder between an open position wherein said intake aperture is aligned with said intake valve port, and a closed position wherein said intake aperture is out of alignment with said intake valve port;

a hollow exhaust valve piston coaxial with said exhaust valve cylinder and having an exhaust aperture therein, said exhaust valve piston rotatable within said exhaust valve cylinder between an open position wherein said exhaust aperture is aligned with said exhaust valve port, and a closed position wherein said exhaust aperture is out of alignment with said exhaust valve port.

51. An engine according to claim 50 wherein said intake valve port is defined at least in part by an intake aperture in said intake valve cylinder, said intake aperture is aligned with an aperture in said compression cylinder, and said intake valve cylinder is disposed exterior to said compression cylinder.

52. An engine according to claim 50 wherein said exhaust valve port is defined at least in part by an exhaust aperture in said exhaust valve cylinder, said exhaust aperture is aligned with an aperture in said compression cylinder, and said exhaust valve cylinder is disposed exterior to said compression cylinder.

53. An engine according to claim 50 wherein:

said intake valve port is defined at least in part by an intake aperture in said intake valve cylinder, said intake aperture is aligned with an aperture in said compression piston;

said exhaust valve port is defined at least in part by an exhaust aperture in said exhaust valve cylinder, said exhaust aperture is aligned with an aperture in said compression piston whereby working fluid may flow through said compression piston; and said intake valve cylinder and said exhaust valve cylinder are disposed on said compression piston.

54. An engine according to claim 50 wherein said cam drive assembly further comprises a drive axle about which said cams rotate, and further comprising:

an intake valve axle in operative connection with said intake valve piston and said drive axle, wherein rotation of said drive axle imparts rotary motion to said intake valve axle to open and close said import valve; and an exhaust valve axle in operative connection with said exhaust valve piston and said drive axle, wherein rotation of said drive axle imparts rotary motion to said exhaust valve axle to open and close said exhaust valve.

55. An engine according to claim 54 further comprising a power lever mounted for pivotal motion on said frame, and operatively connected to said compression piston.

56. An engine according to claim 55 further comprising:

an intake valve roller rotatably disposed on said intake valve lever;

an exhaust valve roller rotatably disposed on said intake valve lever;

a transfer roller rotatably disposed on said transfer lever;

a power push roller rotatably disposed on said power lever; and a power retract roller rotatably disposed on said power lever.

57. An engine according to claim 56 wherein said plurality of cams comprises:

an intake valve cam in rolling contact with said intake valve roller;

an exhaust valve cam in rolling contact with said exhaust valve roller;

a transfer cam in rolling contact with said transfer roller;

a compression push cam in rolling contact with said power push roller; and a compression retract cam in rolling contact with said power retract roller;

wherein each of said cams comprises an eccentric profile, and further wherein the rotation of any one of said cams induces pivotal movement in a corresponding one of said levers.

58. An engine according to claim 54 wherein said plurality of cams are mounted on said cam drive axle for rotation at a uniform angular velocity, and further comprising a flywheel disposed on said cam drive axle.

59. An engine according to claim 54 further comprising a compression push rod mounted for reciprocating linear translation in relation to said frame, and operatively connected to said compression piston.

60. An engine according to claim 59 further comprising means for mounting said push rod for reciprocating translational movement, said mounting means comprising:

a transverse shaft;

at least two pairs of connection arms pivotally connected to said transverse shaft; and at least two pairs of crank arms, each said crank arm pivotally connected to a corresponding connection arm, and each said connection arm pivotally connected to said frame;

wherein said push rod is connected to said transverse shaft, and wherein at least two of said crank arms are drivable in opposite directions by the rotation of one of said plurality of cams, thereby to induce translation of said push rod along the axis of said rod.

61. An engine according to claim 45 wherein said compression chamber is further defined by a supplemental compression cylinder, and further comprising:

a supplemental compression piston slidable for reciprocating motion within said supplemental compression cylinder cooperatively with the sliding of said compression piston; and a passageway for fluid communication between said compression cylinder and said supplemental compression cylinder.

62. An engine according to claim 61 further comprising a supplemental valve in operative connection with said supplemental cylinder for permitting working fluid to be drawn into and exhausted from said supplemental compression chamber.

63. An engine according to claim 42 further comprising:

a second compression chamber into which a second unit mass of working fluid may be drawn, said second compression chamber defined at least in part by a second compression cylinder;

a second compression piston slidable for reciprocating motion within said second compression cylinder, non-cooperatively with said compression piston, to draw said second unit mass into said second compression chamber and to isentropically compress said second unit mass to said higher temperature and said higher pressure;

passage means for fluid communication between said heat exchanger and said first compression chamber, and between said heat exchanger and said second compression chamber, respectively; and valve means for controlling flow of working fluid through said passage means;

wherein:

said heat exchanger is disposed operatively between said second compression chamber and said transfer chamber;

said heat exchanger imparts thermal energy to said working fluid while at least a portion of said second unit mass is moving past said heat exchanger under the urging of said second compression piston, whereby said at least a portion of said second unit mass isothermally expands to a first subsequent volume; and said compression pistons reciprocate out of phase in relation to each other.

64. An engine according to claim 63 further comprising:

intake valves in communication with corresponding ones of said compression chambers, and movable between an open condition for allowing working fluid to be drawn into said engine and a closed condition to prevent working fluid from exhausting from said engine; and exhaust valves in communication with corresponding ones of said compression chambers, and movable between an open condition for allowing working fluid to exit said engine and a closed condition to prevent working fluid from being drawn into said engine.

65. An engine according to claim 64 wherein:

said compression piston is movable in said compression cylinder to push at least a portion of said unit mass from said compression chamber, past said heat exchanger, and toward said transfer chamber;

said second compression piston is movable in said second compression cylinder to push at least a portion of said second unit mass from said second compression chamber, past said heat exchanger, and toward said transfer chamber;

wherein when said compression piston is isothermally compressing said unit mass, said second compression piston is moving to perform at least one function selected from the group consisting of isentropically expanding working fluid, exhausting working fluid, intaking working fluid, and isentropically compressing working fluid.

66. A method for converting thermal energy to mechanical energy, comprising the steps of:

providing a unit mass of working fluid;

isentropically compressing the unit mass of working fluid to a higher temperature and a higher pressure;

isothermally expanding the unit mass to a first subsequent volume while adding thermal energy to the unit mass from a source external to the working fluid, thereby moving at least one driving member;

isentropically expanding the unit mass to a second subsequent volume, thereby moving at least one driving member; and exhausting to ambient environment at least a portion of the unit mass of working fluid.

67. A method according to claim 66 wherein providing a unit mass of working fluid comprises supplying air.

68. A method according to claim 66 wherein providing a unit mass of working fluid comprises expanding a compression chamber to draw working fluid.

69. A method according to claim 68 wherein expanding a compression chamber comprises moving a compression piston in a compression cylinder.

70. A method according to claim 68 wherein providing a unit mass further comprises the step of expanding a transfer chamber to draw working fluid.

71. A method according to claim 70 wherein expanding a transfer chamber comprises moving a transfer piston in a transfer cylinder.

72. A method according to claim 66 wherein isentropically compressing the unit mass comprises reducing the volume of a compression chamber containing working fluid.

73. A method according to claim 72 wherein reducing the volume of a compression chamber comprises moving a compression piston in a compression cylinder.

74. A method according to claim 72 wherein the volume of the compression chamber is reduced while the volume of a transfer chamber, in fluid communication with the compression chamber, is maintained substantially constant.

75. A method according to claim 72 wherein compressing the unit mass further comprises the step of reducing the volume of a transfer chamber in fluid communication with the compression chamber.

76. A method according to claim 75 wherein the volume of the transfer chamber is reduced while reducing the volume of the compression chamber.

77. A method according to claim 75 wherein reducing the volume of the transfer chamber comprises moving a transfer piston in a transfer cylinder.

78. A method according to claim 66 wherein adding thermal energy to the unit mass comprises moving at least a portion of the unit mass past a heat exchanger.

79. A method according to claim 78 wherein moving at least a portion of the unit mass past a heat exchanger comprises forcing at least a portion of the unit mass from a compression chamber into a transfer chamber in fluid communication with the compression chamber.

80. A method according to claim 79 wherein moving at least a portion of the unit mass comprises moving substantially all the unit mass past a heat exchanger.

81. A method according to claim 79 wherein forcing at least a portion of the unit mass from a compression chamber into a transfer chamber comprises forcing substantially all the unit mass from the compression chamber into the transfer chamber.

82. A method according to claim 66 wherein expanding the unit mass to a first subsequent volume while adding thermal energy to the unit mass, thereby moving at least one driving member, comprises moving a transfer piston within a transfer cylinder.

83. A method according to claim 82 wherein expanding the unit mass to a first subsequent volume while adding thermal energy to the unit mass, thereby moving at least one driving member, comprises the further step of moving a compression piston within a compression cylinder.

84. A method according to claim 83 wherein the moving of the transfer piston begins during an early period of the isothermal expansion, before the moving of the compression piston begins during a later period of the isothermal expansion.

85. A method according to claim 66 wherein isentropically expanding the unit mass to a second subsequent volume, thereby moving at least one driving member, comprises moving a compression piston within a compression cylinder.

86. A method according to claim 66 wherein isentropically expanding the unit mass to a second subsequent volume, thereby moving at least one driving member, comprises the further step of forcing at least a portion of the unit mass from a transfer chamber into a compression cylinder, thereby moving a driving member comprising a piston moveable within a cylinder.

87. A method according to claim 66 wherein exhausting at least a portion of the unit mass of working fluid comprises exhausting the unit mass at a constant pressure.

88. A method according to claim 66 wherein providing a unit mass of working fluid comprises providing a unit mass at an initial temperature, and wherein exhausting at least a portion of the unit mass comprises exhausting the unit mass at a temperature greater than the initial temperature.

* * * * *